US010850817B2

(12) United States Patent
Garthwaite

(10) Patent No.: US 10,850,817 B2
(45) Date of Patent: Dec. 1, 2020

(54) FIN-BASED WATERCRAFT PROPULSION SYSTEM

(71) Applicant: Martin Spencer Garthwaite, Bainbridge Island, WA (US)

(72) Inventor: Martin Spencer Garthwaite, Bainbridge Island, WA (US)

( * ) Notice: Subject to any disclaimer, the term of this patent is extended or adjusted under 35 U.S.C. 154(b) by 0 days.

(21) Appl. No.: 16/430,196

(22) Filed: Jun. 3, 2019

(65) Prior Publication Data

US 2019/0351986 A1 Nov. 21, 2019

Related U.S. Application Data

(63) Continuation of application No. 15/967,552, filed on Apr. 30, 2018, now Pat. No. 10,315,744, and a continuation of application No. 15/101,901, filed on Jun. 4, 2016, now Pat. No. 10,308,335, and a continuation of application No. PCT/US2014/068572, filed on Dec. 4, 2014.

(51) Int. Cl.

| | |
|---|---|
| ***B63H 1/36*** | (2006.01) |
| ***B63B 21/56*** | (2006.01) |
| ***B63B 21/66*** | (2006.01) |
| *B63B 35/00* | (2020.01) |

(52) U.S. Cl.

CPC ..... *B63H 1/36* (2013.01); *B63B 21/56* (2013.01); *B63B 21/66* (2013.01); *B63B 2035/008* (2013.01)

(58) Field of Classification Search

CPC ..... B63H 1/36; B63B 21/56; B63B 21/66
See application file for complete search history.

(56) References Cited

U.S. PATENT DOCUMENTS

| | | | | |
|---|---|---|---|---|
| 5,237,952 | A * | 8/1993 | Rowe | B63B 11/04 114/332 |
| 6,814,634 | B2 * | 11/2004 | Roberts | B63H 11/08 440/38 |
| 6,835,108 | B1 * | 12/2004 | Gieseke | B63H 1/36 440/14 |
| 7,822,552 | B2 * | 10/2010 | Bittleston | G01V 1/3808 702/1 |
| 9,032,900 | B2 * | 5/2015 | Glezer | B63G 8/14 114/330 |
| 9,822,757 | B2 * | 11/2017 | Magnell | F03B 13/10 |
| 9,944,363 | B2 * | 4/2018 | Venables | G05D 1/0875 |
| 2010/0151751 | A1 * | 6/2010 | Jemt | B63H 1/36 440/14 |
| 2013/0239869 | A1 * | 9/2013 | Hesse | B63G 7/02 114/330 |
| 2014/0261129 | A1 * | 9/2014 | Garthwaite | B63B 43/14 114/123 |
| 2016/0304179 | A1 * | 10/2016 | Garthwaite | B63B 21/66 |
| 2018/0312234 | A1 * | 11/2018 | Garthwaite | B63H 1/36 |

(Continued)

*Primary Examiner* — S. Joseph Morano
*Assistant Examiner* — Jovon E Hayes

(57) ABSTRACT

A watercraft comprises a motor, an inertial mass, and a fin. The motor oscillates the inertial mass about an axis, producing a torque reaction on and oscillation of the motor. Oscillation of the motor is communicated to the fin, producing thrust. A fluke, fin, or wing comprises an angle of attack mechanism, wherein the angle of attack mechanism may use power from the fluke, fin, or wing to adjust an angle of attack of the fluke, fin, or wing relative to a surrounding thrust fluid.

7 Claims, 40 Drawing Sheets

(56) References Cited

U.S. PATENT DOCUMENTS

| | | | | |
|---|---|---|---|---|
| 2018/0342938 | A1* | 11/2018 | Fei | B63H 1/36 |
| 2019/0152573 | A1* | 5/2019 | Wiens | B63H 1/36 |
| 2019/0351986 | A1* | 11/2019 | Garthwaite | B63B 21/56 |
| 2019/0360510 | A1* | 11/2019 | Broers | B32B 15/046 |

* cited by examiner

FIN-BASED WATERCRAFT PROPULSION SYSTEM

CROSS-REFERENCE TO RELATED APPLICATIONS

This application claims the benefit of and incorporates herein by this reference, in their entirety, for all purposes, U.S. provisional patent application Ser. No. 61/911,888, filed Dec. 4, 2013, U.S. provisional patent application Ser. No. 61/936,419, filed Feb. 6, 2014, Patent Cooperation Treaty international patent application number PCT/US14/68572, filed Dec. 4, 2014, U.S. patent application Ser. No. 15/101,901, filed Jun. 4, 2016, U.S. provisional patent application No. 62/492,144, filed Apr. 29, 2017, U.S. provisional patent application No. 62/507,275, filed May 17, 2017, U.S. provisional patent application No. 62/618,080, filed Jan. 17, 2018, U.S. provisional patent application No. 62/621,620 filed Jan. 25, 2018, and U.S. patent application Ser. No. 15/967,552, filed Apr. 30, 2018.

BACKGROUND

Design of propeller driven watercraft, including surface craft and submarines, involves a number of well known compromises involving propeller size, placement of the engine, and hull shape, to name but a few of the issues. In addition, the column of thrust fluid propelled by a single propeller rotates. Rotation of the thrust fluid does not produce thrust, though is required in order to move the thrust fluid backward (which does produce thrust). Thrust fluid rotation can be eliminated or at least balanced through the use of two counter-rotating propellers, though this results in twice the propeller surface area and (typically) twice as much drive train complexity, which reduces efficiency. In addition, efficient propeller-driven watercraft achieve roughly 0.7 on a graph of propulsive efficiency and thrust coefficient, and, even then, only in a narrow range of speeds. See, for example, FIG. 31, which is a graph from "Hydrodynamic Flow Control in Marine Mammals", by Frank E. Fish, Laurens E. Howie, and Mark M. Murray, presented in the symposium, "Going with the Flow: Ecomorphological Variation across Aquatic Flow Regimes", presented at the annual meeting of the Society for Integrative and Comparative Biology, Jan. 2-6, 2008, at San Antonio, Tex., United States. The efficiency curve is approximately an inverted parabola. Travel faster or slower than the speed where peak efficiency occurs, and the efficiency of the propeller-driven craft drops off rapidly.

In addition, propeller driven watercraft typically have a drive-shaft which, when the engine is inboard, penetrates the hull and creates the need for a drive-shaft seal (outboard motors have a severe bend in the drive-shaft, which reduces efficiency relative to inboard motors). Drive-shaft seals create friction, require maintenance, and introduce added mechanical complexity (such as a bilge pump).

Electric motors can be utilized which are flooded with a liquid and which thereby reduce the internal-external pressure differential on the drive-shaft seal. Such motors are sometimes found in submarines; however, such motors experience greater friction because the rotor rotates in a liquid, rather than in air, and maintenance is more complex.

In contrast to propellers, fins—marine mammals and fish—have an efficiency/thrust coefficient of approximately 0.8 and the efficiency curve is very flat. See, again, FIG. 31. Traveling faster or slower than the speed of peak efficiency results in only a modest change in efficiency. While vortexes are present in the thrust fluid propelled by a fin, unlike rotation of the column of thrust fluid coming off of a propeller, the vortexes behind a fin counter-rotate. The vortexes form a "reverse von Karman street" pattern, in which downstream vortices, as they spin and release energy over time, appear to pull upstream vortices further downstream, scavenging energy and contributing to overall thrust.

However, connecting a motor to a fin is a complex problem, particularly in a marine environment. Many fin-based propulsion systems have been designed and built, some of which produce a fish-like motion. Often, such systems have tens, hundreds, or even thousands of intricately machined parts with tight tolerances. Often, such systems have multiple moving bearings which are exposed to or which need to be sealed away from water by a "wet" seal (which attempts to seal the moving part or its bearings from water). Often, the bearings in such craft experience asymmetric loads, first on one side and then on the other. Some of such systems rely on exotic, expensive, and fragile materials, such as materials which contract or expand in an electric field.

The sheer number of parts, parts which move, seals, and asymmetrically loaded bearings reduce the efficiency of such systems, increase manufacturing costs, and decrease reliability, rendering most fin-based watecraft propulsion systems impractical for commercial use.

Needed is an inexpensive, efficient, robust, fin-based propulsion system.

Disclosed is an efficient fin-based propulsion system with only one directly powered component which, in some embodiments, is entirely sealed.

DETAILED DESCRIPTION

Figure 1:
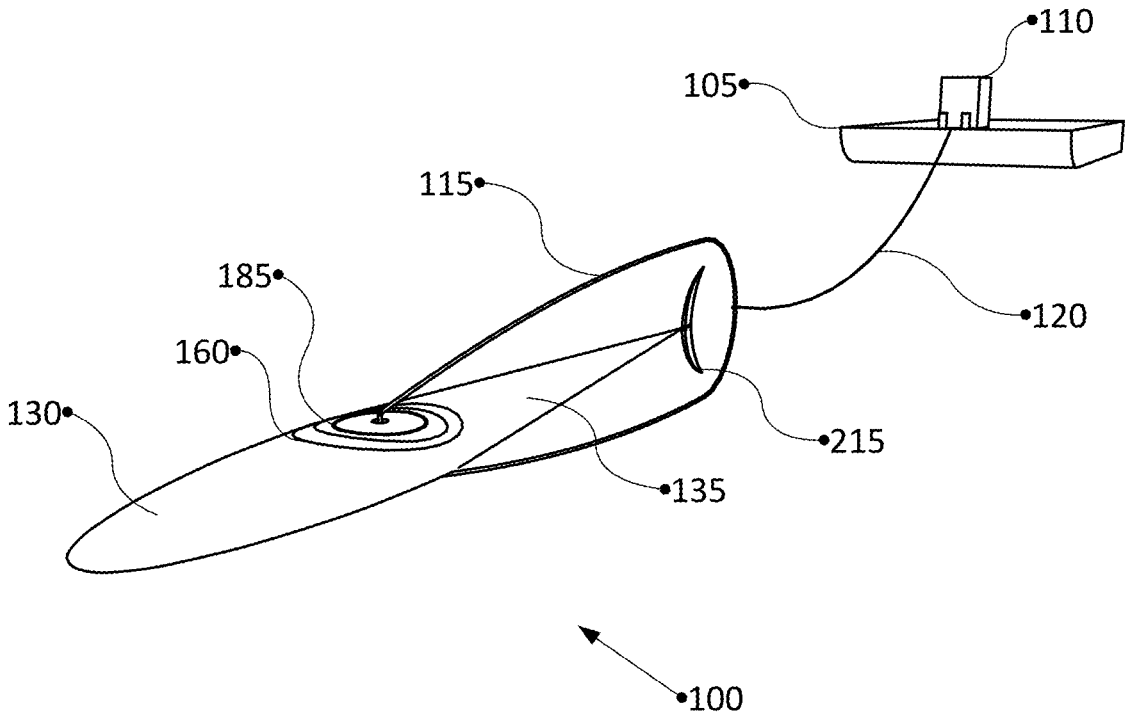
FIG. 1 illustrates a perspective view of an embodiment of a remotely operated Fishboat Vertical Torque Reaction Engine ("TRE") attached to a Barge, which Barge carries a power source.

It is intended that the terminology used in the description presented below be interpreted in its broadest reasonable manner, even though it is being used in conjunction with a detailed description of certain examples of the technology. Although certain terms may be emphasized below, any terminology intended to be interpreted in any restricted manner will be overtly and specifically defined as such in this Detailed Description section.

Unless the context clearly requires otherwise, throughout the description and the claims, the words "comprise," "comprising," and the like are to be construed in an inclusive sense, as opposed to an exclusive or exhaustive sense; that is to say, in the sense of "including, but not limited to." As used herein, the term "connected," "coupled," or any variant thereof means any connection or coupling, either direct or indirect between two or more elements; the coupling of connection between the elements can be physical, logical, or a combination thereof. Additionally, the words, "herein," "above," "below," and words of similar import, when used in this application, shall refer to this application as a whole and not to particular portions of this application. When the context permits, words using the singular may also include the plural while words using the plural may also include the singular. The word "or," in reference to a list of two or more items, covers all of the following interpretations of the word: any of the items in the list, all of the items in the list, and any combination of one or more of the items in the list. References are made herein to routines and subroutines; generally, it should be understood that a routine is a software program executed by computer hardware and that a subroutine is a software program executed within another routine. However, routines discussed herein may be executed within another routine and subroutines may be executed independently (routines may be subroutines and visa versa).

As used herein, "releasable," "connect," "connected," "connectable," "disconnect," "disconnected," and "disconnectable" refers to two or more structures which may be connected or disconnected, generally without the use of tools (examples of tools including screwdrivers, pliers, wrenches, drills, saws, welding machines, torches, irons, and other heat sources) and generally in a repeatable manner. As used herein, "attach," "attached," or "attachable" refers to two or more structures or components which are attached through the use of tools or chemical or physical bonding. As used herein, "secure," "secured," or "securable" refers to two or more structures or components which are either connected or attached.

Described herein are Fishboat and Direct Drive watercraft. Illustrated examples of Fishboat embodiments include Fishboat Vertical TRE 100 and Fishboat Horizontal TRE 1300. Examples of Direct Drive embodiment include Direct Drive Horizontal Engine 270.

As described further herein, Fishboats are watercraft in which a torque reaction engine ("TRE") is within a Capsule, which Capsule may be sealed. The TRE causes the Capsule to cyclically counter-rotate, in one direction and then the other, about a central axis. Cyclic counter-rotation of the Capsule (also referred to herein as "oscillation") is communicated to a Hull or other force transmitting member (referred to herein as a "Hull") which is secured to and generally surrounds the Capsule, producing oscillating yaw when the TRE is oriented on Vertical Axis 225, oscillating pitch when the TRE is oriented on Transverse Axis 230, and oscillating roll when the TRE is oriented on Horizontal Axis 235.

Fin(s) are secured to the Hull. Cyclic counter-rotation (or oscillation) of the Capsule-Hull-Fin(s) through the surrounding thrust fluid generates thrust. In embodiments in which the Hull is a force transmitting member such as a beam, a fairing may be provided in addition to the Hull to streamline the flow of fluid around the Fishboat.

The TRE comprises a Rotor and a Stator. An Inertial Mass is secured to the Rotor; the Rotor and Inertial Mass are cyclically counter-rotated (or oscillated) by the Stator, in one direction and then the other, about an axis of rotation. Cyclic counter-rotation of the Inertial Mass causes an alternating torque reaction on the Stator. The Stator is secured to or forms the interior of the Capsule. The alternating torque reaction on the Stator causes the Capsule to cyclically counter-rotate. The Inertial Mass may be symmetric about a central axis shared with the Motor, though in alternative embodiments, the Inertial Mass may asymmetric about the Motor's central axis.

Figure 2:
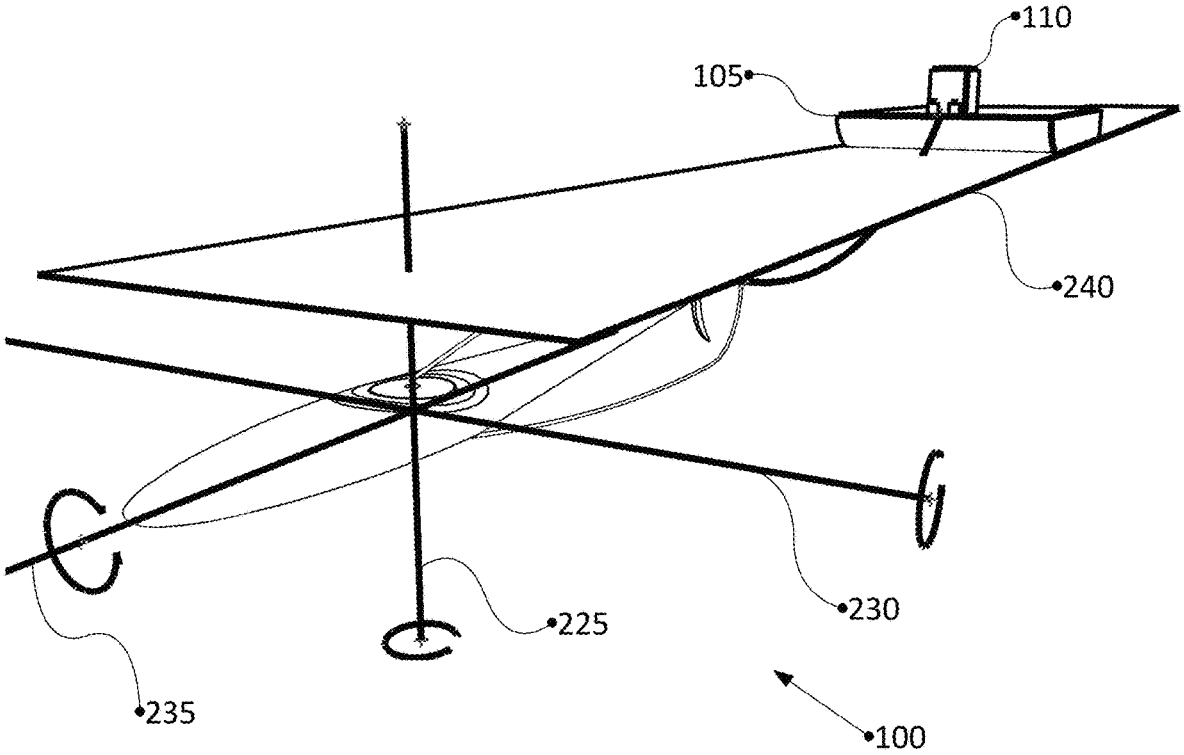
FIG. 2 illustrates the Fishboat of FIG. 1 in the same view, further illustrating a Horizontal Axis, Vertical Axis, Transverse Axis, and Waterline.
Figure 14:
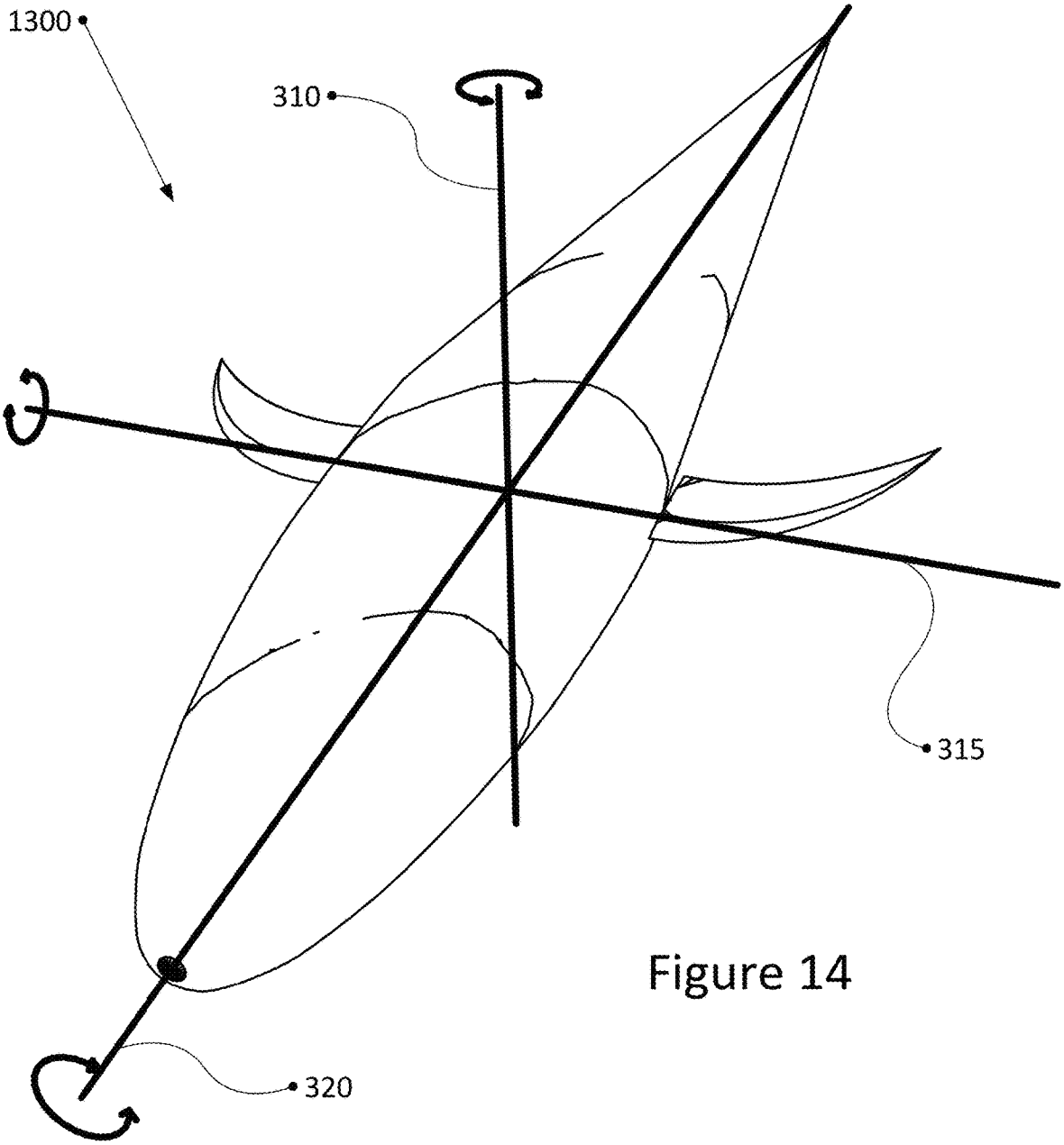
FIG. 14 illustrates the Fishboat of FIG. 13 in the same view, further illustrating a Horizontal Axis, Vertical Axis, and Transverse Axis.

The central axis of the Motor may be, for example, the Horizontal Axis 235, Vertical Axis 225, or Transverse Axis 230 (see FIG. 2 or equivalent axis illustrated in FIG. 14). If the TRE is oriented around a Vertical Axis 225—as in example embodiment of Fishboat Vertical TRE 100—the TRE causes oscillating yaw of the Fishboat about the Vertical Axis 225 and the Fishboat swims like a fish, with a vertically oriented rear Fin. If the TRE is oriented around a Transverse Axis 230, the TRE causes oscillating pitch of the Fishboat about the Transverse Axis 230 and the Fishboat swims like a marine mammal, with a horizontally oriented rear Fin—as in an example embodiment in FIG. 7 of U.S. Provisional Patent Application Ser. No. 61/911,888. If the TRE is oriented along a Horizontal Axis 235, the TRE causes oscillating roll of the Fishboat about the Horizontal Axis 235 and the Fishboat swims with a cyclically counter-rotating (or oscillating) screw-type motion, as in embodiments of Fishboat Horizontal TRE 1300.

The Motor may be an "outrunner" style electric motor, in which a central Stator is surrounded by a Rotor and the Inertial Mass is secured to the Rotor. The Motor and Inertial Mass may be provided by an internal combustion engine or the like, though this paper uses an electric motor as an example of the TRE, because electric motors are mechanically simple, do not require flow of an oxidizer or other chemicals into and exhaust of combustion or other reaction products out of the TRE and are flexible inasmuch as a wide range and rate of rotations of the Inertial Mass may be implemented. In embodiments in which the Motor is electric, a brushless DC motor may be used. A mechanically commutated brushed electric motor may be used, though a brushless motor offers reduced maintenance. A combustion-based TRE may utilize various rotary motor configurations, such as wherein a piston (including equivalent structures in a rotary engine) cyclically compresses and ignites gas and fuel in an enclosure, with release of the exhaust gases cyclically oscillating the Inertial Mass. As noted, the Inertial Mass may be asymmetric, though embodiments illustrated in this paper discuss a symmetric Inertial Mass.

The Inertial Mass may be provided by, for example, lead, iron, a battery pack, or the like.

Figure 12:
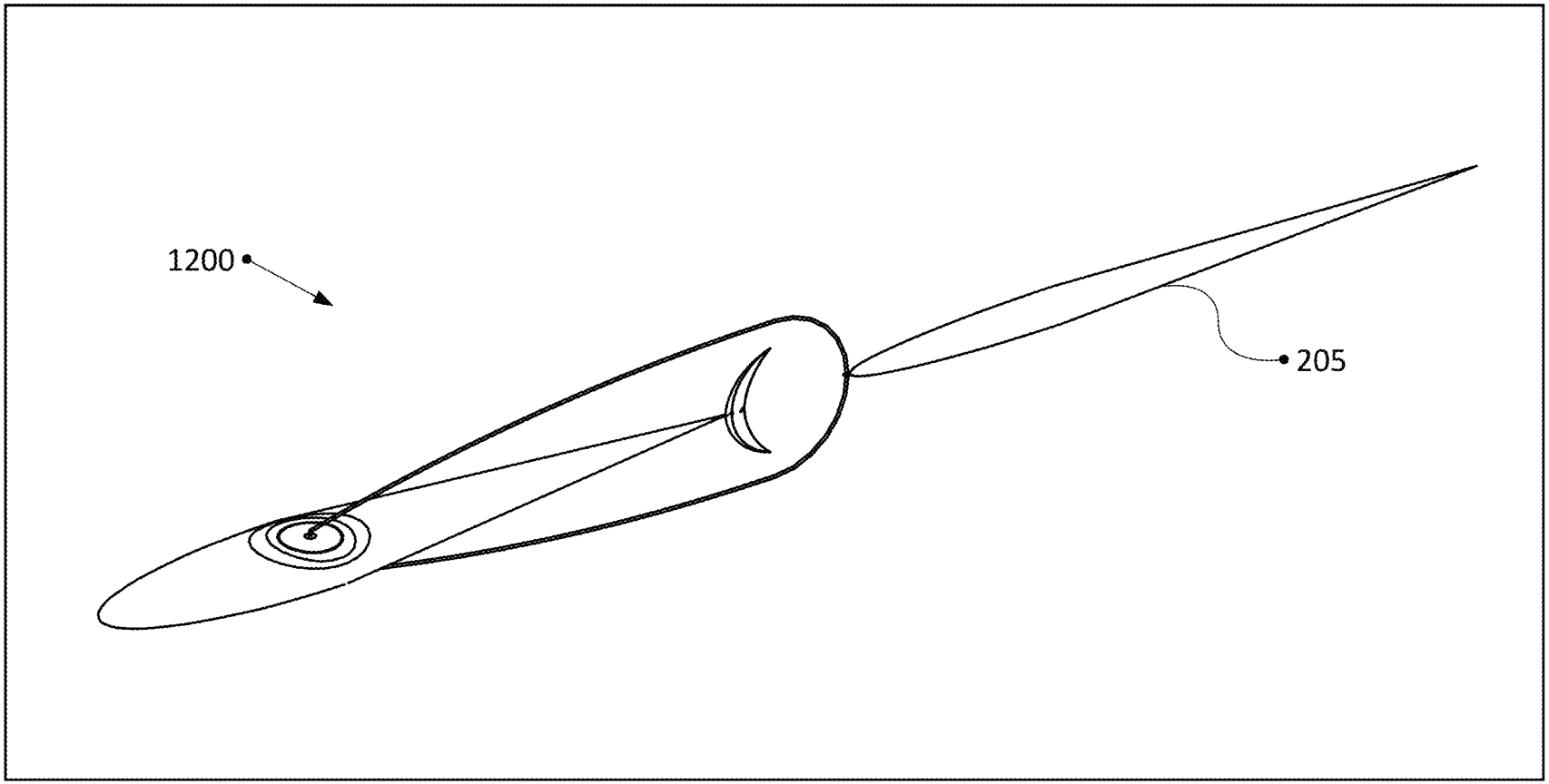
FIG. 12 illustrates a perspective view of an embodiment of a remotely operated Fishboat Vertical TRE attached to a Streamlined Battery Pack containing a power source.

In the case of an electric Motor, electrical power may be obtained from a Power Source. The Power Source may be on a Barge or other vessel towed by the Fishboat or the Power Source may internal to the Fishboat. If towed on a Barge, the Power Source may be a solar panel, a battery pack, a fuel cell, or a generator (wind, fossil fuel, or the like). If internal to the Fishboat, the Power Source may be a battery pack or fuel for an internal combustion engine. An embodiment is illustrated in FIG. 12 in which the Power Source is towed in a vessel such as a Steamlined Battery Pack 205.

Fin(s) may be secured to the Fishboat. If secured to the Fishboat at the center of displacement of the Fin (which is also generally the wide point, ⅓rd back from the leading edge of the Fin, for a typical wing cross-section), but with nothing to resist rotation, Fin(s) will find the path of least resistance through the thrust fluid. Flexible Beam(s) may be included in the securement between Fin(s) and Fishboat, causing the Fin(s) to deflect in the thrust fluid less than the path of least resistance, causing the Fin(s) to achieve an angle of attack sufficient to generate thrust. The bending modulus of the Flexible Beam may be adjustable, to change the angle of attack achieved by the Fin(s). Though generally the Flexible Beam passively articulates due to forces experienced by the Fin as the Fin(s) translate through the thrust fluid (allowing the Fins to find the angle of attack based on the modulus of flexibility), the Flexible Beam may comprise actuator(s) to bend the Flexible Beam or to change the normal angle between the Flexible Beam and the Hull, which may be done for purposes of achieving a desired angle of attack or which may be done to steer the Fishboat.

The Fishboat may also be steered by re-positioning the center of gravity of the TRE relative to the Fin and Hull. For example, in a Fishboat in which the TRE rotates about the Vertical Axis 225 to produce thrust and in which the TRE has a center of gravity located below the Horizontal Axis 235, the Capsule may be re-positioned along the Transverse Axis 230, which causes the Fishboat to roll to an angle off of horizontal and results in a steering force. See, for example, FIGS. 8A and 8B. The Fishboat may also be steered by producing more torque with the TRE on one side of it's cycle (such as by counter-oscillating the TRE further in one direction than the other) or by relaxing the Flexible Beam on one side, which may result in a difference in thrust between the sides, which produces a steering force.

The Fishboat comprises sensors to detect the relative and/or absolute position of various components and/or the strain experienced by components. For example, sensors may be present to sense a bend in the Flexible Beam, to detect the orientation of the craft (in terms of roll, pitch, and yaw), the position of the Inertial Shell and Rotor relative to the Stator, the orientation of the center of gravity of the TRE relative to the Hull, the orientation and angle of attack of the Fin(s), the status of the Stator and Rotor (such as magnetic fields, electrical current, etc.), the status of the Power Source, and the like.

The sensors may be part of electronic circuits, some of which may form feedback circuits, such as a circuit which controls power to the Stator and rotates the Inertial Shell until the craft yaws, rolls, or pitches (in the opposite direction of the rotation of the Inertial Shell) to a selected position relative to the normal direction of travel or until a bending angle is achieved in the Flexible Beam or until an angle of attack is obtained in the Fin(s), whereupon the feedback circuit may cause the rotation of the Inertial Shell to slow and reverse until the craft yaws or rolls in the other direction to an equivalent position, whereupon the rotation of the Inertial Shell may be slowed and reversed again, etc. When the Fishboat is at rest, the bending modulus of the Flexible Beam may be started at a flexible setting, with the bending modulus made more stiff as speed increases.

The Direct Drive Craft is an embodiment with even fewer moving parts and no Inertial Mass, but which requires a flexible membrane, such as Membrane 285, a wet seal, or water tolerant bearings.

Both Fishboat and Direct Drive Craft are mechanically simple, physically robust, and provide greater efficiency than propeller driven craft.

FIG. 1 illustrates a perspective view of an embodiment of a remotely operated Fishboat Vertical TRE 100 attached to a Barge 105, which Barge 105 carries a Power Source 110. Identified in this Figure are Nose 130, Tail 135, Fluke 215, Top Bearing 160, Central Tube 185, Symmetrical Harness 115, and Tether 120. Nose 130 and Tail 135 have approximately the same displacement. Displacement between Nose 130 and Tail 135 may be adjustable, to change the normal pitch of the craft. Overall displacement of the entire craft may be increased or decreased to change the normal depth of the craft in the water.

FIG. 2 illustrates the Fishboat of FIG. 1 in the same view, further illustrating Horizontal Axis 235, Vertical Axis 225, Transverse Axis 230, and Waterline 240. As discussed herein, roll is rotation about Horizontal Axis 235, yaw is rotation about Vertical Axis 225, and pitch is rotation about Transverse Axis 230.

Figure 3A:
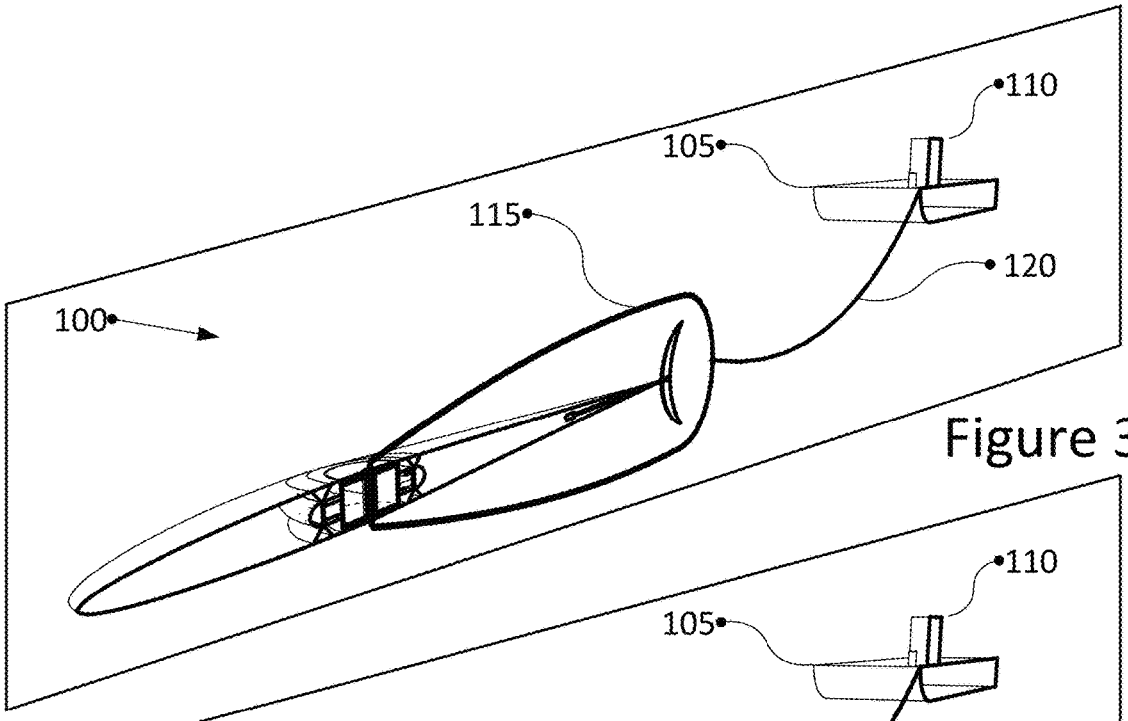
FIG. 3A illustrates the perspective view of the Fishboat of FIG. 1, with a section cut along the Horizontal Axis and a Symmetric Harness.

FIG. 3A illustrates the perspective view of the Fishboat of FIG. 1, with a section cut along Horizontal Axis 235 and Symmetric Harness 115 and Catenary 120. FIGS. 1, 2, and 3A and Fishboat Vertical TRE 100 may be compared, one page and figure to the other. The securement point between Catenary 120 and Symmetric Harness 115 may be moved up or down along the trailing arc of Symmetric Harness 115, such as to change the pitch of the Fishboat.

Figure 3B:
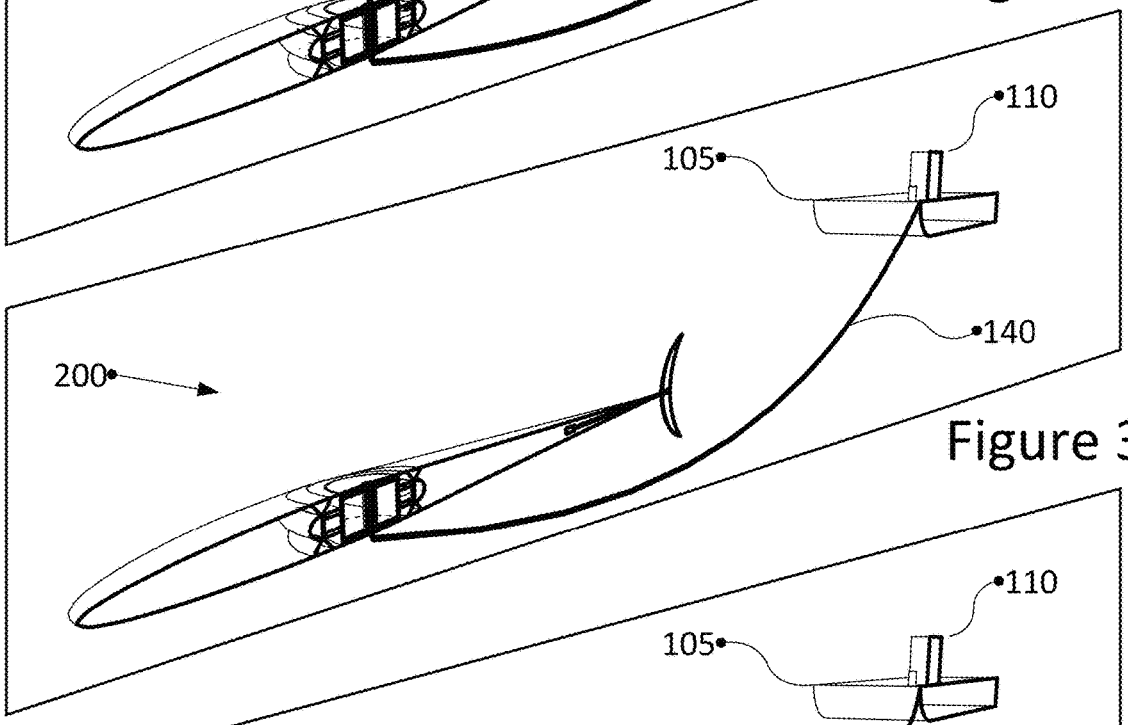
FIG. 3B illustrates a Fishboat Vertical TRE embodiment with the same view and section cut of FIG. 3A, but with an Asymmetric Bottom Harness.

FIG. 3B illustrates a Fishboat Vertical TRE embodiment with the same view and section cut of FIG. 3A, but with an Asymmetric Bottom Harness 140, generally forming a catenary drape.

Figure 3C:
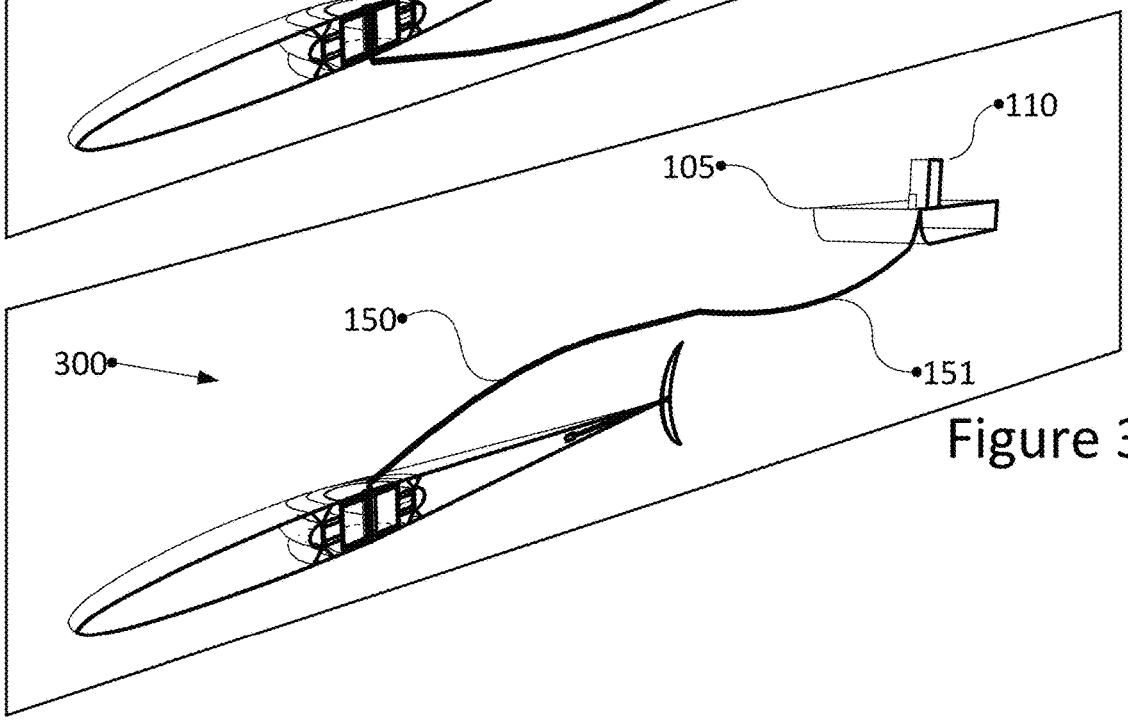
FIG. 3C illustrates a Fishboat Vertical TRE embodiment with the same view and section cut of FIG. 3A, but with an Asymmetric Top Harness.

FIG. 3C illustrates a Fishboat Vertical TRE embodiment with the same view and section cut of FIG. 3A, but with an Asymmetric Top Harness 150 and Catenary 151. To change the weight of Asymmetric Bottom Harness 140 or Catenary 120 or Catenary 151, more or less Harness may be released from or drawn back onto Barge 105. Components may be incorporated into the attachment point between Symmetric Harness 115, Asymmetric Bottom Harness 140, or Asymmetric Top Harness 150, to change the normal angle between the Harness and the craft, for example, to cause the Fishboat to pitch or to allow more room between the Fluke and the Harness.

Figure 4A:
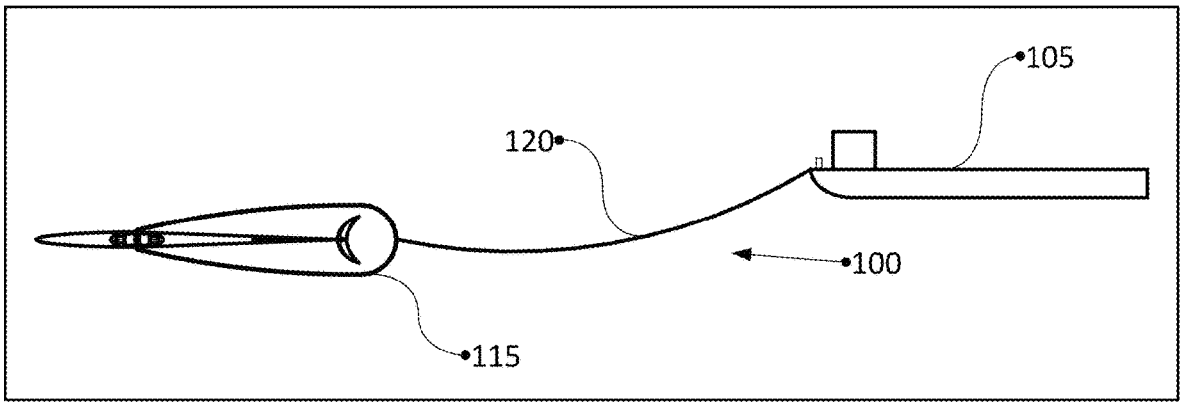
FIG. 4A illustrates the Fishboat embodiment of FIG. 3A, with section cut, in a side elevation parallel projection view.

FIG. 4A illustrates the Fishboat embodiment of FIG. 3A, with section cut, in a side elevation parallel projection view.

Figure 4B:
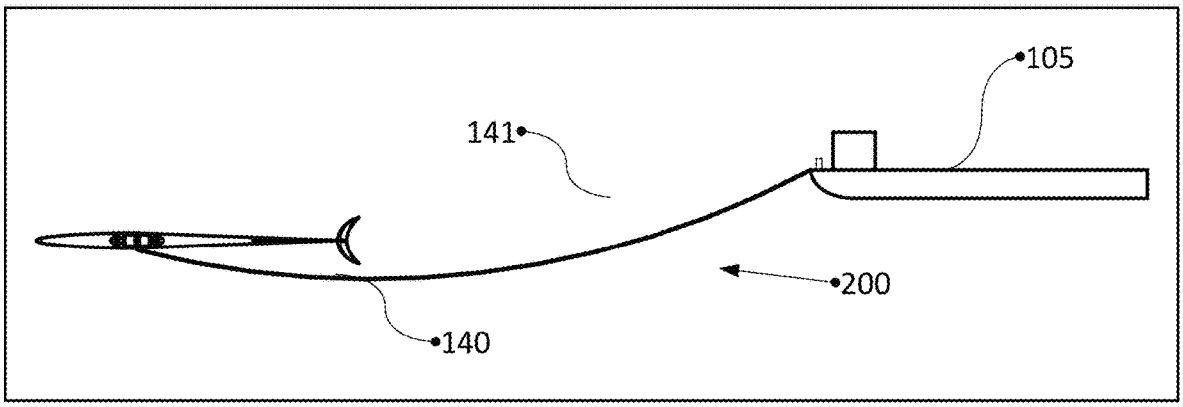
FIG. 4B illustrates the Fishboat embodiment of FIG. 3B, with section cut, in a side elevation parallel projection view.

FIG. 4B illustrates the Fishboat embodiment of FIG. 3B, with section cut, in a side elevation parallel projection view.

Figure 4C:
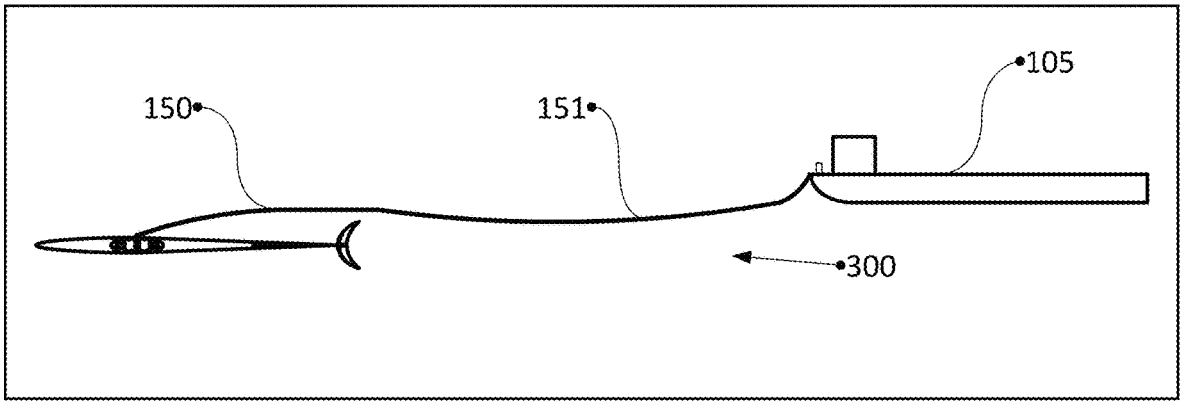
FIG. 4C illustrates the Fishboat embodiment of FIG. 3C, with section cut, in a side elevation parallel projection view.

FIG. 4C illustrates the Fishboat embodiment of FIG. 3C, with section cut, in a side elevation parallel projection view.

Figure 5A:
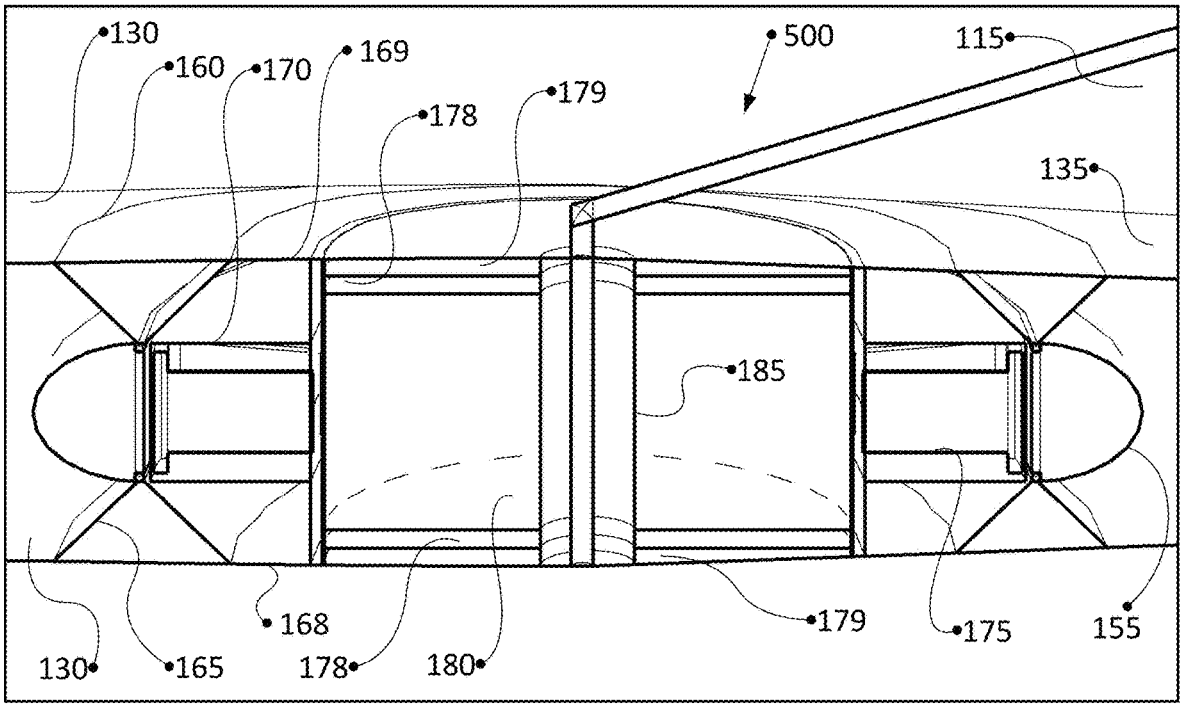
FIG. 5A illustrates a close perspective view of an embodiment of a Vertical TRE, generally as found in the embodiments illustrated in FIGS. 1-4C, with a section cut along the Horizontal Axis.

FIG. 5A illustrates a close perspective view of an embodiment of Vertical TRE 500, generally as found in the embodiments illustrated in FIGS. 1-4C, with a section cut along Horizontal Axis 235. Illustrated are Nose 130 and Tail 135, which contact Top Bearing 160 and Bottom Bearing 165. Top Bearing 160 and Bottom Bearing 165 support Inertial Mass 155 and allow Inertial Mass 155 to rotate about Vertical Axis 225. The Bearings may be located closer to Central Tube 185. In this embodiment, Inertial Mass 155 is faced with Permanent Magnets 156. Magnets 156 (which may be permanent) interact with Electromagnets 175 in Stator 170. Also illustrated are Rectifier 178, Space 179, Capacitor 180, Central Tube 185, and a Harness, in this example, Symmetrical Harness 115. Central Tube 185 and the Harness may be mediated by a bearing, such as a water tolerant set of ball bearings, though they may also be mediated by a bearing interface between the components, such as a brass-on-brass interface. In an example illustrated in FIGS. 26A and 26B, a Hitching Post 345 may project through the Central Tube 185 and secured with Collar 250.

Electric power may be delivered through the Harness or through power lines which exit the Harness and, via Energy Transfer Circuit 415 (see FIG. 30), enter Capacitor 180. Capacitor 180 is labeled as a "capacitor", but may be another power reservoir, such as a capacitor, a battery, or the like. Ultracapacitors can be cycled 500,000 to 1 million times, and require little to no maintenance. Power exits Capacitor 180 and enters Power Transfer Circuit 420, which may incorporate or be connected to Rectifier 178, which may deliver power, such as three-phase power, to TRE or Motor 400. Rectifier 178 may utilize DC-DC boost to extract braking energy at lower speeds. A circuit diagram is provided in FIG. 30. Part or all of Energy Transfer Circuit 415 may be located in Space 179 and/or in Cavity 168 or Cavity 169 between Bottom Bearing 165 or Top Bearing 160 the interior wall of Stator 170 frame and/or on the Barge. Power Transfer Circuit 420 may be present in Rectifier 178 and/or in Cavity 168 or Cavity 169. Control Circuit 425 may control Motor 400, Power Transfer Circuit 420, Energy Transfer Circuit 415, and may obtain information from and/or control Sensors-Actuators 430.

Figure 5B:
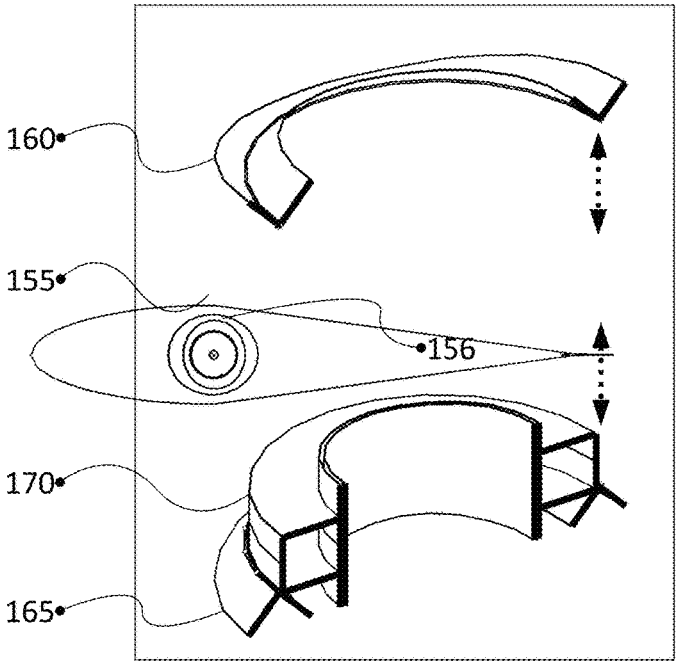
FIG. 5B illustrates a perspective view of a Top Bearing, an Inertial Mass, a Stator Area, and a Bottom Bearing of a Vertical TRE, generally as found in the embodiments illustrated in FIGS. 1-4C, with a section cut along the Horizontal Axis and with the components partially disassembled.

FIG. 5B illustrates a perspective view of Top Bearing 160, Inertial Mass 155, Stator 170, and Bottom Bearing 165, generally as found in the embodiments illustrated in FIGS. 1-4C, with a section cut along the Horizontal Axis and with the components partially exploded (in FIG. 5B, Bottom Bearing 165 is in position relative to Stator 170). A conventional "outrunner" electric torque motor may be used, with Inertial Mass mounted to the rotor.

Figure 5C:
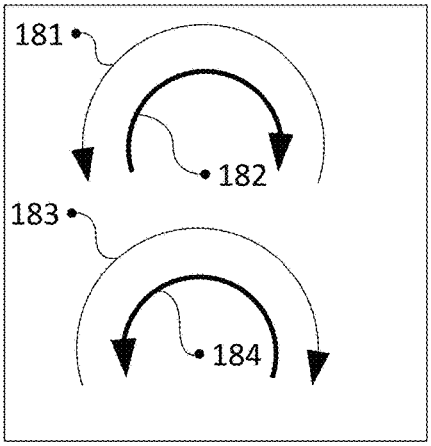
FIG. 5C illustrates a full TRE cycle.

FIG. 5C illustrates a full TRE cycle, starting from the top, with acceleration of Inertial Mass in a counter-clockwise direction, illustrated in Arc 181, which produces a torque reaction in Stator which drives Stator in a clockwise direction, illustrated in Arc 182, followed by acceleration of Inertial Mass in a clockwise direction, illustrated in Arc 183, which produces a torque reaction in Stator which drives Stator in a counter-clockwise direction, illustrated in Arc 184.

Figure 6A:
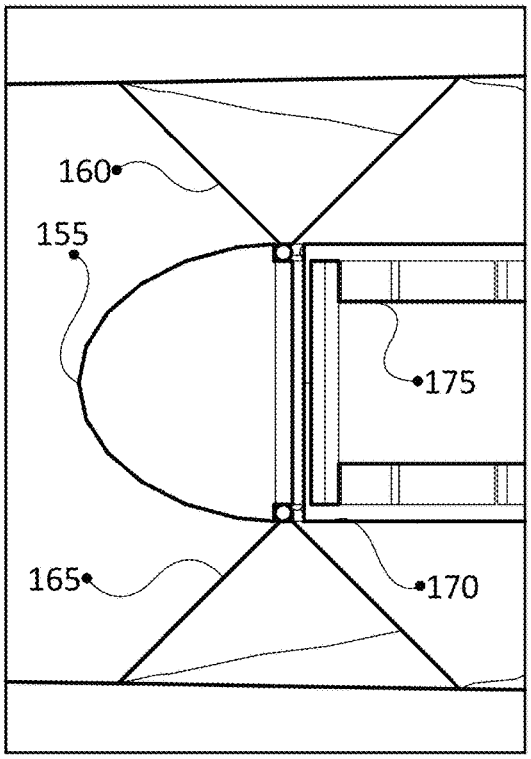
FIG. 6A illustrates a close parallel projection view of a portion of a Vertical TRE, generally as found in the embodiments illustrated in FIGS. 1-4C, with a section cut along the Horizontal Axis.
Figure 6B:
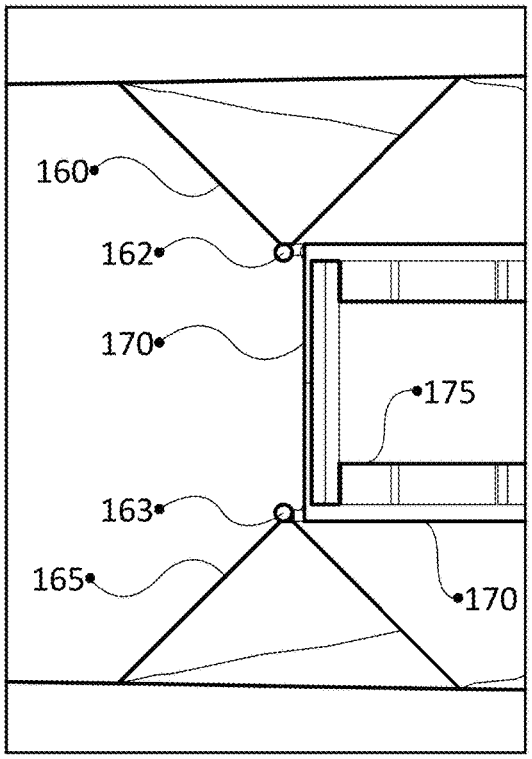
FIG. 6B illustrates the view of the portion of the TRE of FIG. 6A, with Inertial Mass not showing.
Figure 6C:
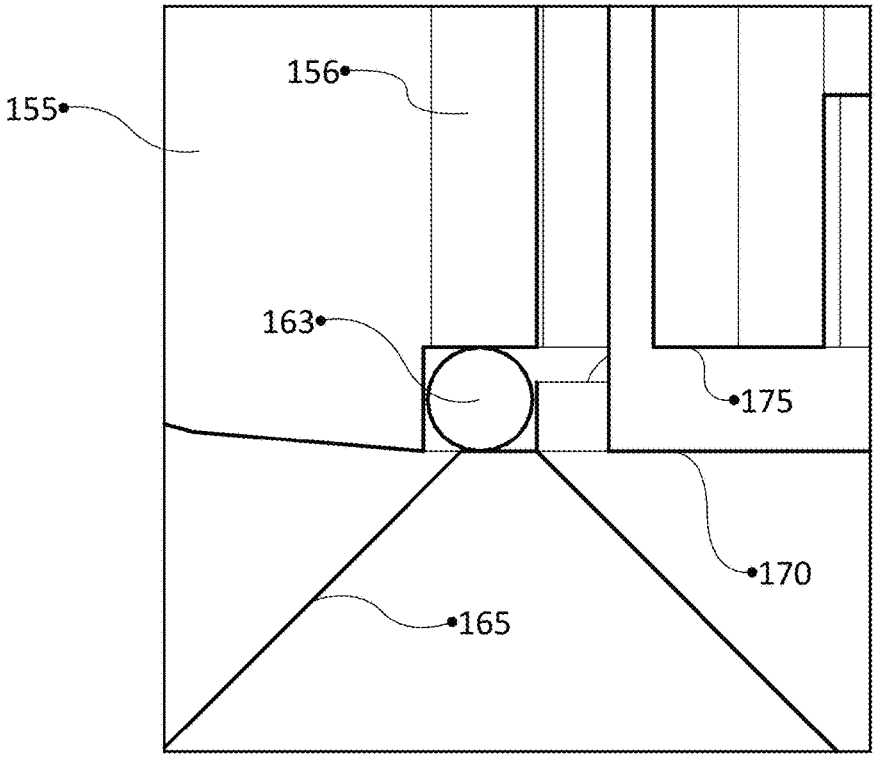
FIG. 6C illustrates a detail of FIG. 6A.

FIG. 6A illustrates a close parallel projection view of a portion of Vertical TRE 500, generally similar to the TRE embodiments illustrated in FIGS. 1-4C, with a section cut along Horizontal Axis 235. FIG. 6B illustrates the view of the portion of the Vertical TRE 500 of FIG. 6A, with Inertial Mass 155 not showing. Also labeled in this Figure are Bearing Top 162 and Bearing Bottom 163. Bearings 162 and 163 are illustrated as ball bearings, though bearings of another shape may be used, such as, for example, roller bearings. FIG. 6C illustrates a detail of FIG. 6A. Together, FIG. 6A-6C illustrate components which do not move, relative to the one component which moves, Inertial Mass 155. FIG. 6C also illustrates the air gap between Inertial Mass 155-Magnet 156 and Stator 170. Per the discussion above, Electromagnets 175 in Stator 170 rotate Magnets 156 in Inertial Mass 155 first one way, then the other, around Vertical Axis 225, causing an opposing torque reaction in Electromagnets 175 and Stator 170. Because Electromagnets 175 and Stator 170 are anchored in or otherwise secured to Hull (in, for example, Nose 130 and Tail 135), the opposing torque reaction in Electromagnets 175 and Stator 170 is communicated to Fin(s), such as, for example, Fluke 215.

Figure 7:
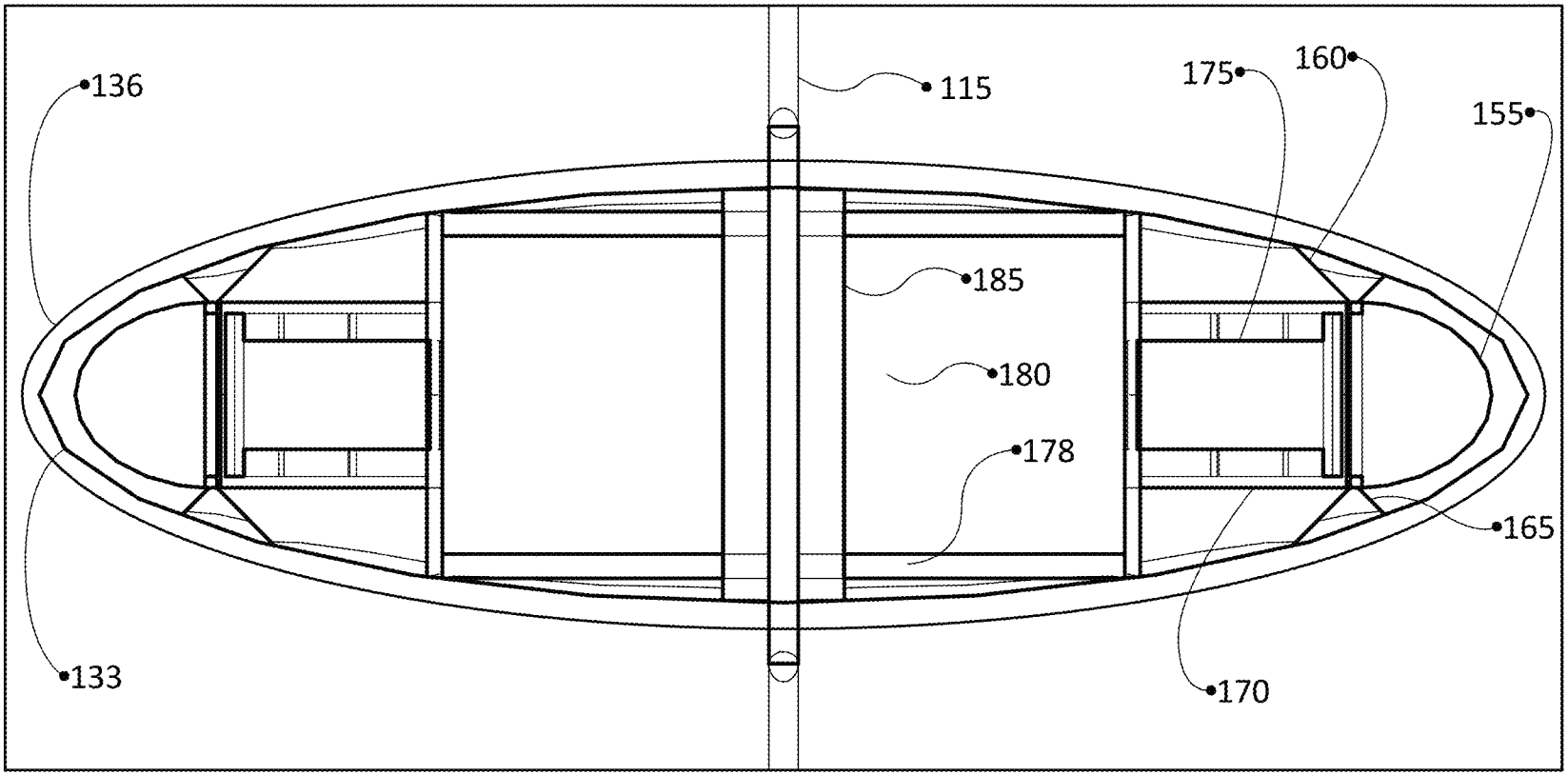
FIG. 7 illustrates a front elevation parallel projection view of an embodiment of a Vertical TRE in a Fishboat embodiment, generally as found in the embodiments illustrated in FIGS. 1-4C, with a section cut along the Transverse Axis.

FIG. 7 illustrates a front elevation parallel projection view of an embodiment of a Fishboat Vertical TRE, generally as found in the embodiments illustrated in FIGS. 1-4C, with a section cut along the Transverse Axis and many of the elements identified by number. FIG. 7 also illustrates Outer Shell 136 and Capsule 133

Figure 8A:
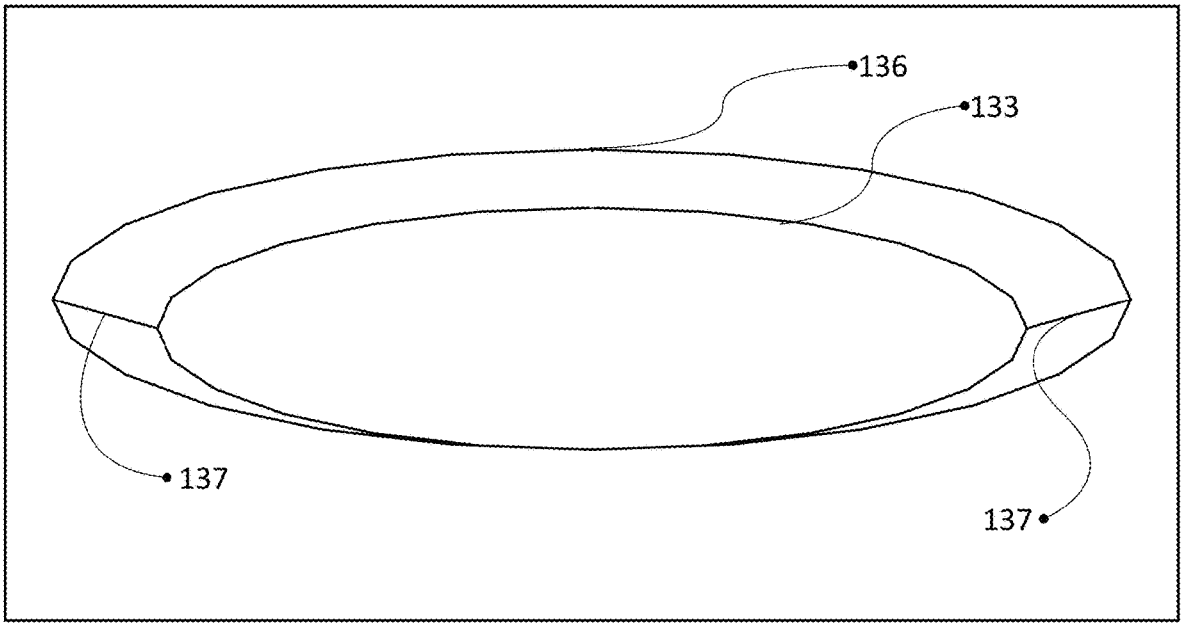
FIG. 8A illustrates a front elevation parallel projection view of a schematic embodiment of a Vertical TRE in a Fishboat, further illustrating a Transverse TRE Position Adjustor.
Figure 8B:
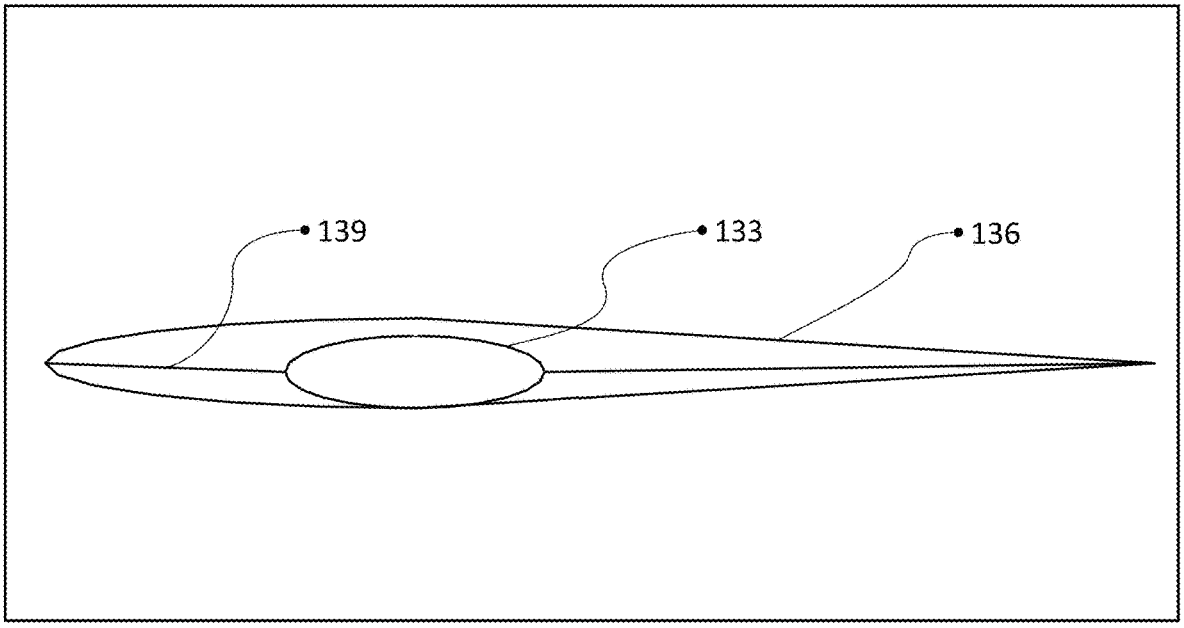
FIG. 8B illustrates a side elevation parallel projection view of a schematic embodiment of a Vertical TRE in a Fishboat, further illustrating a Horizontal TRE Position Adjustor.

FIG. 8A illustrates a front elevation parallel projection view of a schematic embodiment of a Vertical TRE in a Fishboat, further illustrating Transverse TRE Position Adjustor 137. FIG. 8B illustrates a side elevation parallel projection view of a schematic embodiment of a Vertical TRE in a Fishboat, further illustrating a Horizontal TRE Position Adjustor 139. Transverse TRE Position Adjustor 137 and Horizontal TRE Position Adjustor 139 may be used to adjust the position of Capsule 133, containing TRE. Adjustment of position may be performed to trim the orientation of the craft in the water and/or to provide a steering force. As illustrated, Capsule 133 is located approximately at the center of displacement and slightly below Horizontal Axis 235. Motor(s) (not illustrated) may provide power to drive Transverse TRE Position Adjustor 137 and Horizontal TRE Position Adjustor 139.

Figure 9A:
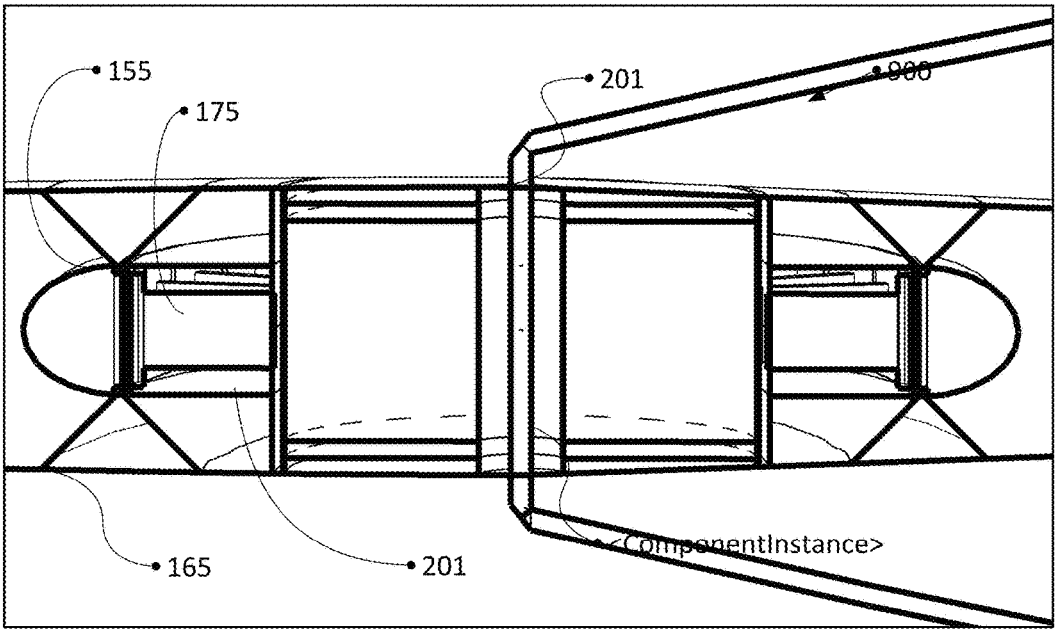
FIG. 9A illustrates a parallel projection view of certain electrical and magnetic components of an embodiment of a Vertical TRE with a section cut along the Horizontal Axis.
Figure 9B:
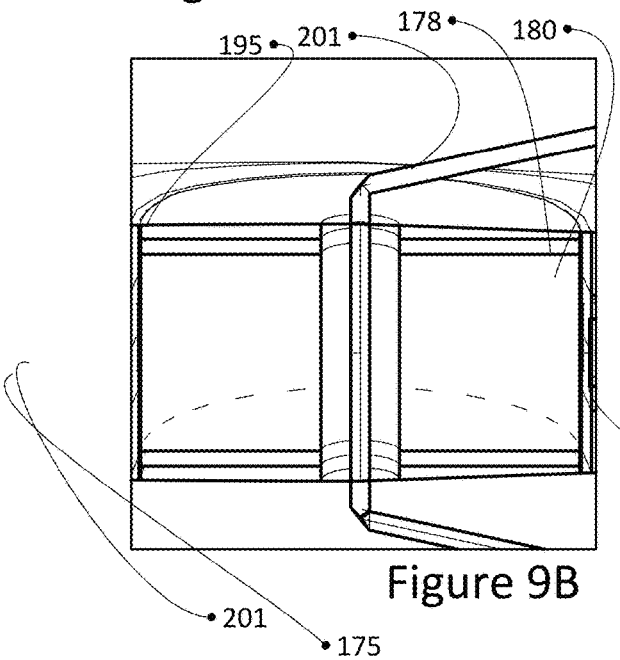
FIG. 9B illustrates a perspective view of certain electrical and magnetic components of an embodiment of a Vertical TRE in wireframe.
Figure 9C:
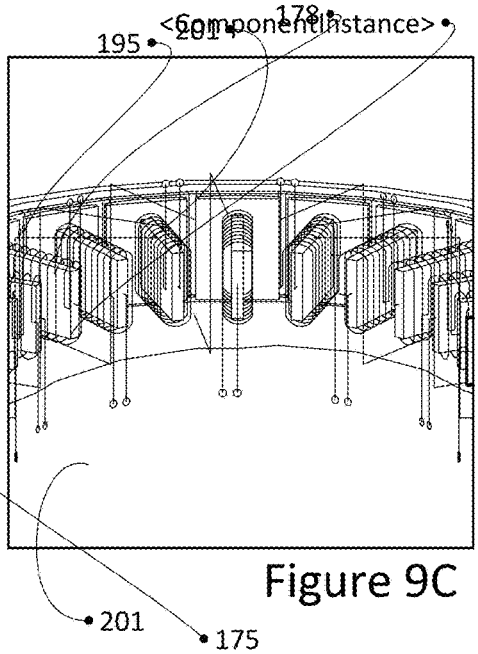
FIG. 9C illustrates the view and components of FIG. 9B, in hidden-line.

FIG. 9A illustrates a parallel projection view of certain electrical and magnetic components of an embodiment of a Vertical TRE 900 with a section cut along the Horizontal Axis. FIG. 9B illustrates a perspective view of certain electrical and magnetic components of the Vertical TRE of FIG. 9A, in wireframe and without the section cut. FIG. 9C illustrates the view, components, and reference numbers of FIG. 9B, in hidden-line (which helps to identify where the number lines in FIG. 9B point to). Labeled in FIGS. 9A-9C are Inertial Mass 155, Bottom Bearing 165, Hall Effect Sensor(s) and Hall Effect Sensor wires 201, Electromagnets 175, Rectifier 178, Capacitor 180, and Winding-Rectifier Connection Wires 195. Because the Rectifier may be split into two components (the Rectifier may be in just the top or just the bottom), the Winding-Rectifier Connection Wires 195 are illustrated extending both upward and downward. Hall Effect Sensor(s) may be hall effect sensors, optical position sensors, or other sensors which detect the position of Inertial Mass 155 and/or Magnet(s) 156 (or DD Rotor 280) relative to Stator 170 and Electromagnets 175.

Various winding patterns may be followed for Electromagnets in Stator. For example, Wye configuration gives high torque at low speed, but not as high top speed, which may be desirable in this context.

Figure 10:
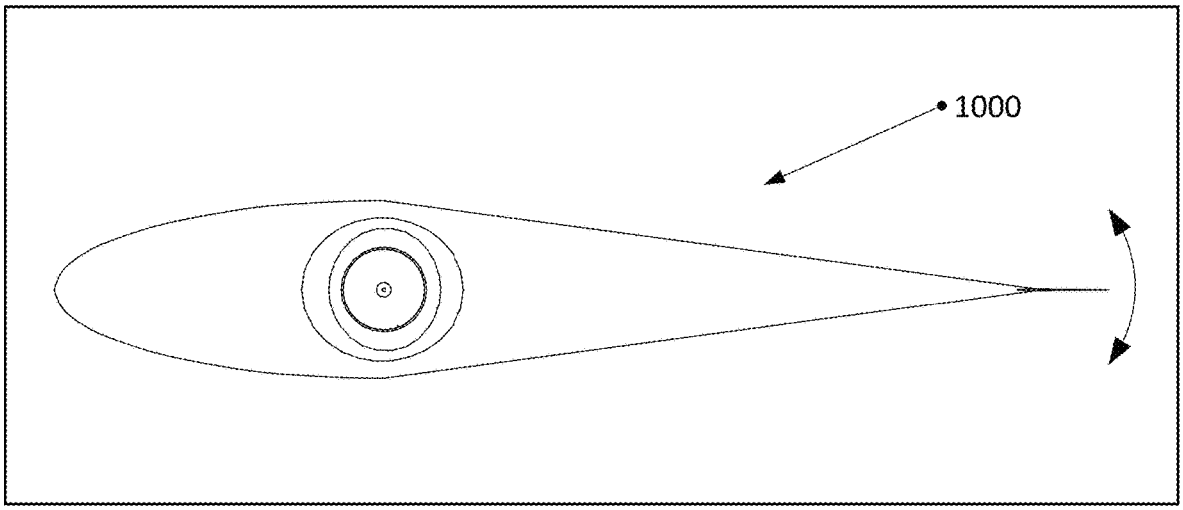
FIG. 10 illustrates a top plan parallel projection view of an embodiment of a Fishboat Vertical TRE.

FIG. 10 illustrates a top plan parallel projection view of an embodiment of a Fishboat Vertical TRE 1000. An arrow arc indicates oscillation of the aft of Fishboat Vertical TRE 1000 due to torque reaction. A corresponding oscillation occurs at the bow of Fishboat Vertical TRE 1000.

Figure 11A:
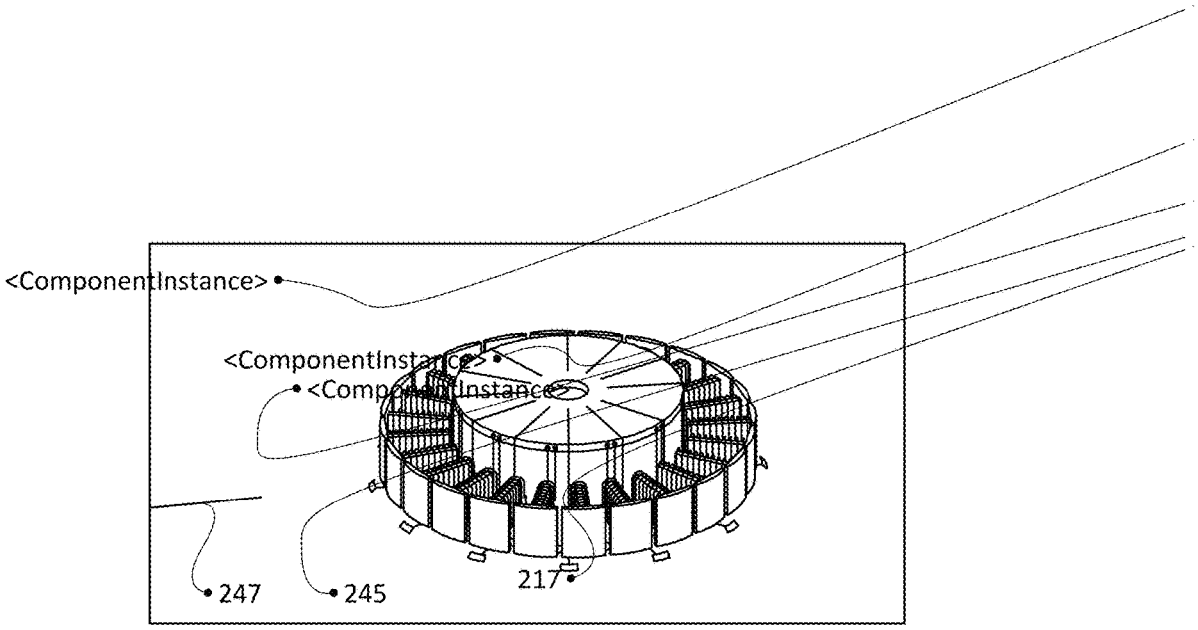
FIG. 11A illustrates a parallel projection view of an embodiment of Fluke-Flex adjustment components in a first position.
Figure 11B:
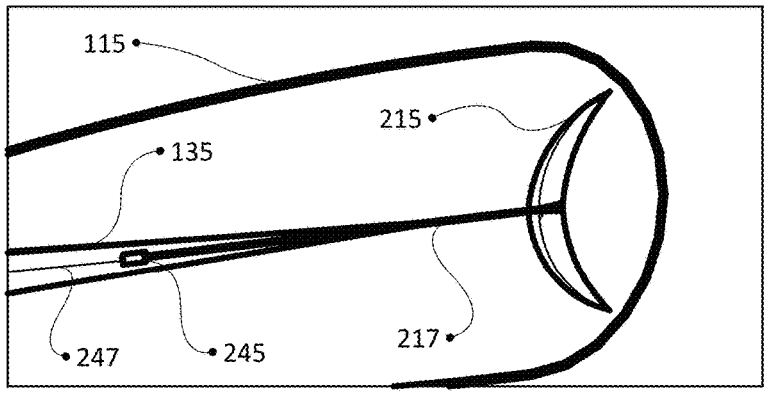
FIG. 11B illustrates the view and components of FIG. 11A, with Fluke-Flex adjustment components in a second position.

FIG. 11A illustrates a parallel projection view of an embodiment of Flexible Beam adjustment components in a first position. FIG. 11B illustrates the view and components of FIG. 11A, with Fluke-Flex adjustment components in a second position. In the embodiment illustrated in these Figures, Fluke 215 is secured to Flexible Beam 217, which may be, for example, a rod made of carbon fiber or another flexible material. Flexible Beam may extend into Tail 135, inside of a tube with an inside diameter just slightly larger than the outside diameter of Flexible Beam 217, allowing Flexible Beam 217 to slide back and forth within the tube within Tail 135. Fluke Extender 245 may comprise components, such as a motor, a rack and pinion system, a hydraulic system, or the like, to slide Flexible Beam 217 back and forth within the tube within Tail 135. When Flexible Beam 217 is extended, as in FIG. 11B, Fluke 215 will deflect further when the Fishboat yaws about Vertical Axis 225 than when Flexible Beam 216 is withdrawn inside of the tube within Tail 135. This is an example embodiment of components to change or adjust the bending modulus of the Flexible Beam, which will change the angle of attack achieved by Fluke 215 when the craft yaws back and forth, driven by TRE.

Flexible Extender 245 may logically connect to Control Circuit 425 via Deflection Sensor-Actuator Connector 247, providing information to Control Circuit 425 regarding the length of extension of Flexible Beam 217, regarding the deflection of Flexible Beam 217, regarding the orientation of Flexible Beam 217 relative to the Hull, and the like.

Flexible Beam 217 may rotate on the horizontal plane about its connection with Tail 135, such as by operation of a motor which may pull Flexible Extender 245 back and forth within Tail 135, allowing Flexible Beam 217 and Fluke 215 to be used to provide a steering force (for an alternative embodiment, see, for example, FIGS. 10A and 10B in U.S. Provisional Patent Application Ser. No. 61/911,888, in which a steering disk is located at the connection point between the Fluke and the Tail).

FIG. 12 illustrates a perspective view of an embodiment of a remotely operated Fishboat Vertical TRE 1200 attached to a Streamlined Battery Pack 205 containing a Power Source, such as a battery. The position of the Streamlined Battery Pack 205 may be adjusted, such as up and down along the trailing arc of Symmetrical Harness 115, to change the pitch of the Fishboat. Streamlined Battery Pack 205 may also be used to steer the Fishboat 1200. Streamlined Battery Pack 205 may be used with a Harness which is not symmetrical.

Figure 13:
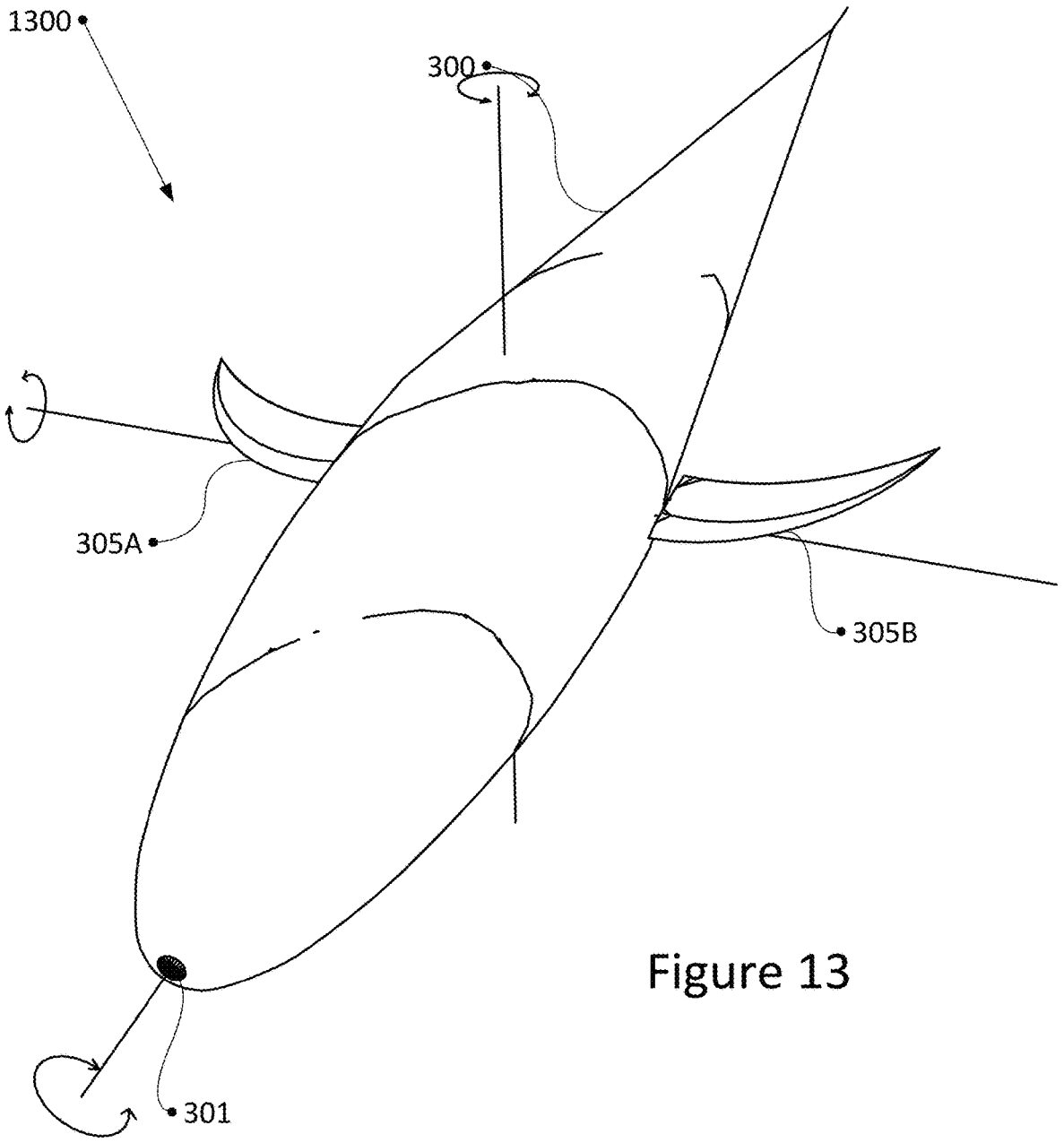
FIG. 13 illustrates a perspective view of an embodiment of a Fishboat Horizontal TRE.

FIG. 13 illustrates a perspective view of an embodiment of a Fishboat Horizontal TRE 1300. Identified are Spinner Hull 300, Starboard Fin 305A, Port Fin 305B, and Sensor Hole 301. Spiral lines are drawn on Spinner Hull 300 in these figures to provide a visual reference.

FIG. 14 illustrates the Fishboat of FIG. 13 in the same view, further illustrating Horizontal Axis 320, Vertical Axis 310, and Transverse Axis 315. The waterline is generally above the level of the Fishboat 1300, which may generally operate fully submerged and at great depth, because no drive-shaft penetrates Spinner Hull 300.

Figure 15:
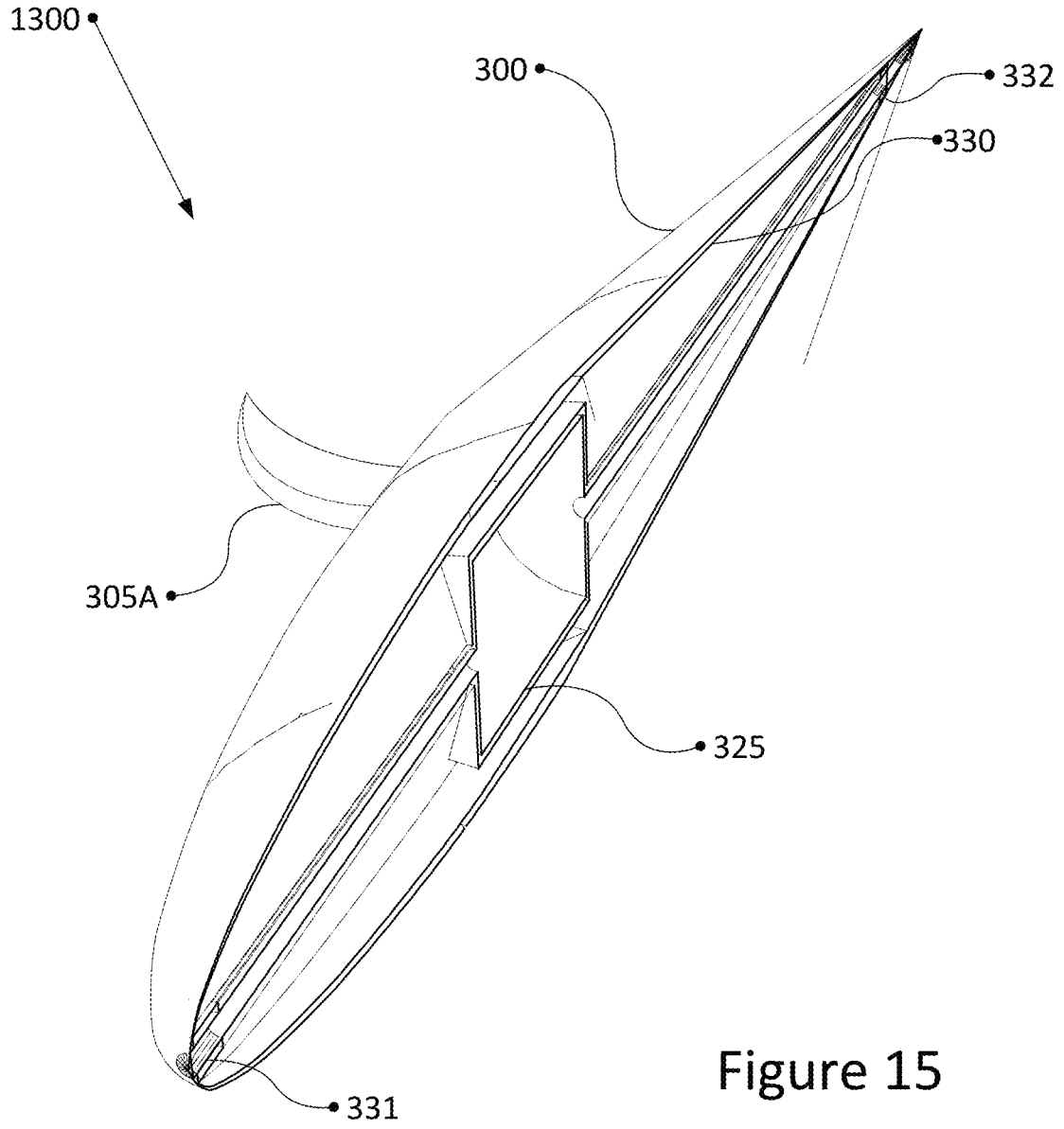
FIG. 15 illustrates the Fishboat of FIG. 13, with a section cut along the Horizontal Axis.

FIG. 15 illustrates Fishboat 1300, with a section cut along Horizontal Axis 320, providing a view of, for example, Spinner Inertial Mass 330, Spinner Motor 325, Forward Bearing 331, and Aft Bearing 332. Similar to the TRE oriented along the Vertical Axis, with the TRE oriented along Horizontal Axis 320, Spinner Motor 325 remains stationary and attached to Spinner Hull 300. Spinner Motor 325 interacts with Spinner Inertial Mass 330, rotating Spinner Inertial Mass 330 first in one direction, then the other, about Horizontal Axis 320, causing an alternating torque reaction against the Spinner Motor 325, which is attached to Spinner Hull 300, which is secured to Fin 305A and 305B. Spinner Inertial Mass 330 may not touch Spinner Motor 325 directly, but instead may be supported on Spinner Motor 325 by Forward Bearing 331 and Aft Bearing 332.

Figure 30:
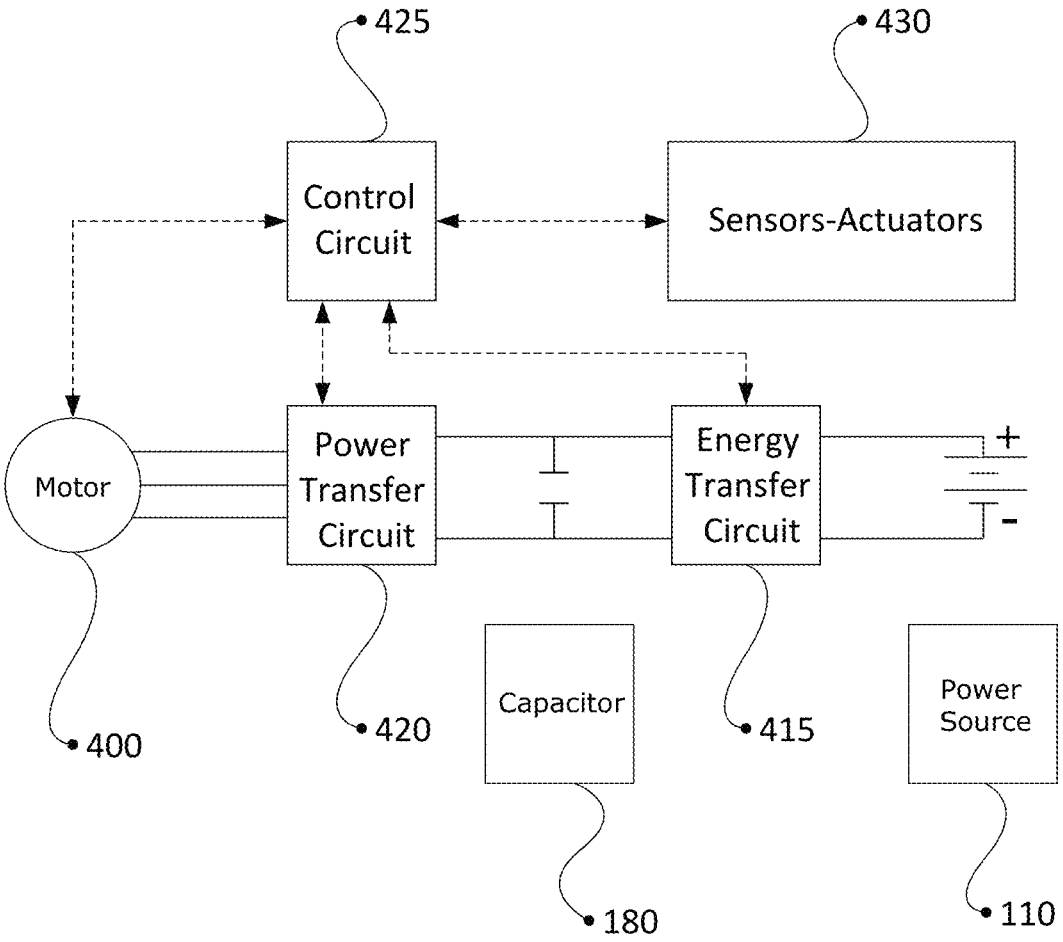
FIG. 30 illustrates an embodiment of a set of circuits which may be used to control a TRE and a Fishboat or a Direct Drive Craft.
Figure 31:
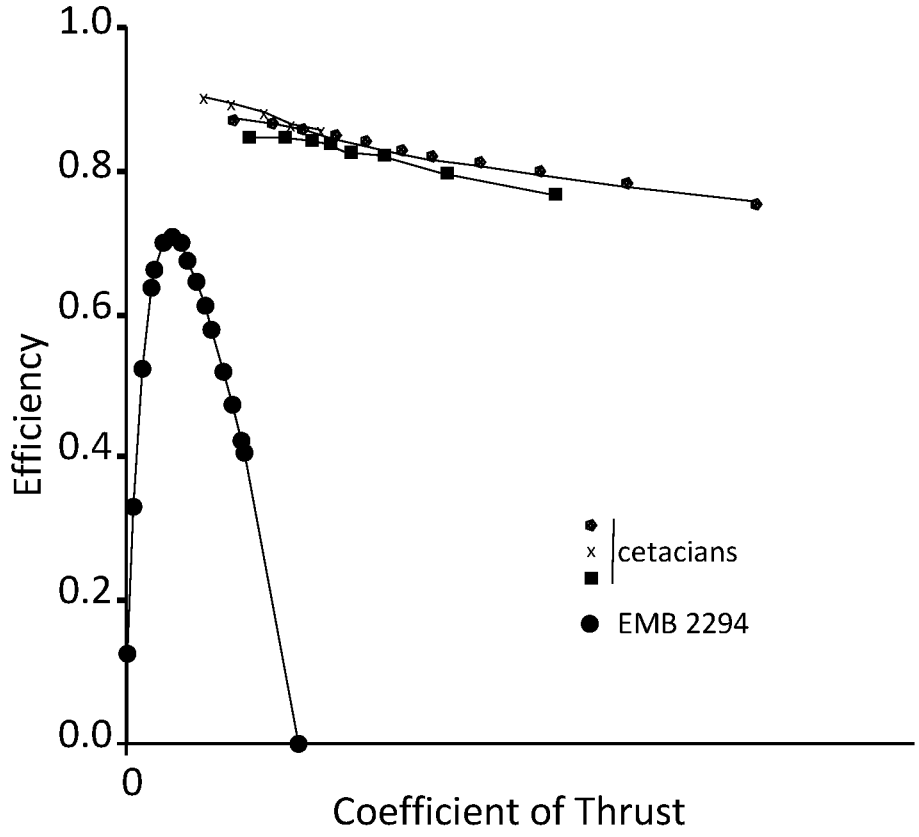
FIG. 31 is a graph of the efficiency over coefficient of thrust for propellers and cetaceans.

In addition to allowing Spinner Inertial Mass 330 to rotate about Horizontal Axis 320, Forward Bearing 331 and Aft Bearing 332 may also carry electrical power between Spinner Inertial Mass 330, which may comprise a battery, and Spinner Motor 325, as well as components which may control Spinner Motor 325 (equivalent to components illustrated in FIG. 30). Electrical contacts may be provided on, for example, the aft or forward end of Spinner Motor 325, which electrical contacts may be used to charge a battery in Spinner Inertial Mass 330 and/or to provide or obtain electrical power to Fishboat 1300.

Any of the Fishboat embodiments illustrated herein may be positioned in a moving current of water, secured to a line or the like, and may generate power from movement of the thrust fluid over Fin(s), in which case the Flexible Beam securing Fin(s) may be biased to present the Fin(s) with an alternating angle of attack to the thrust fluid, such that the Fishboat oscillates much as it would when net power is supplied to (rather than generated by) the TRE.

Induction principals may be used in any TRE to induce a current and/or magnetic field in components which otherwise may not have a direct electrical connection. For example, permanent or electromagnets may be present in one or both of the Spinner Inertial Mass and the Spinner Motor 325. The TRE may be or incorporate a polyphase double cage AC induction motor with variable-frequency drive.

Figure 16:
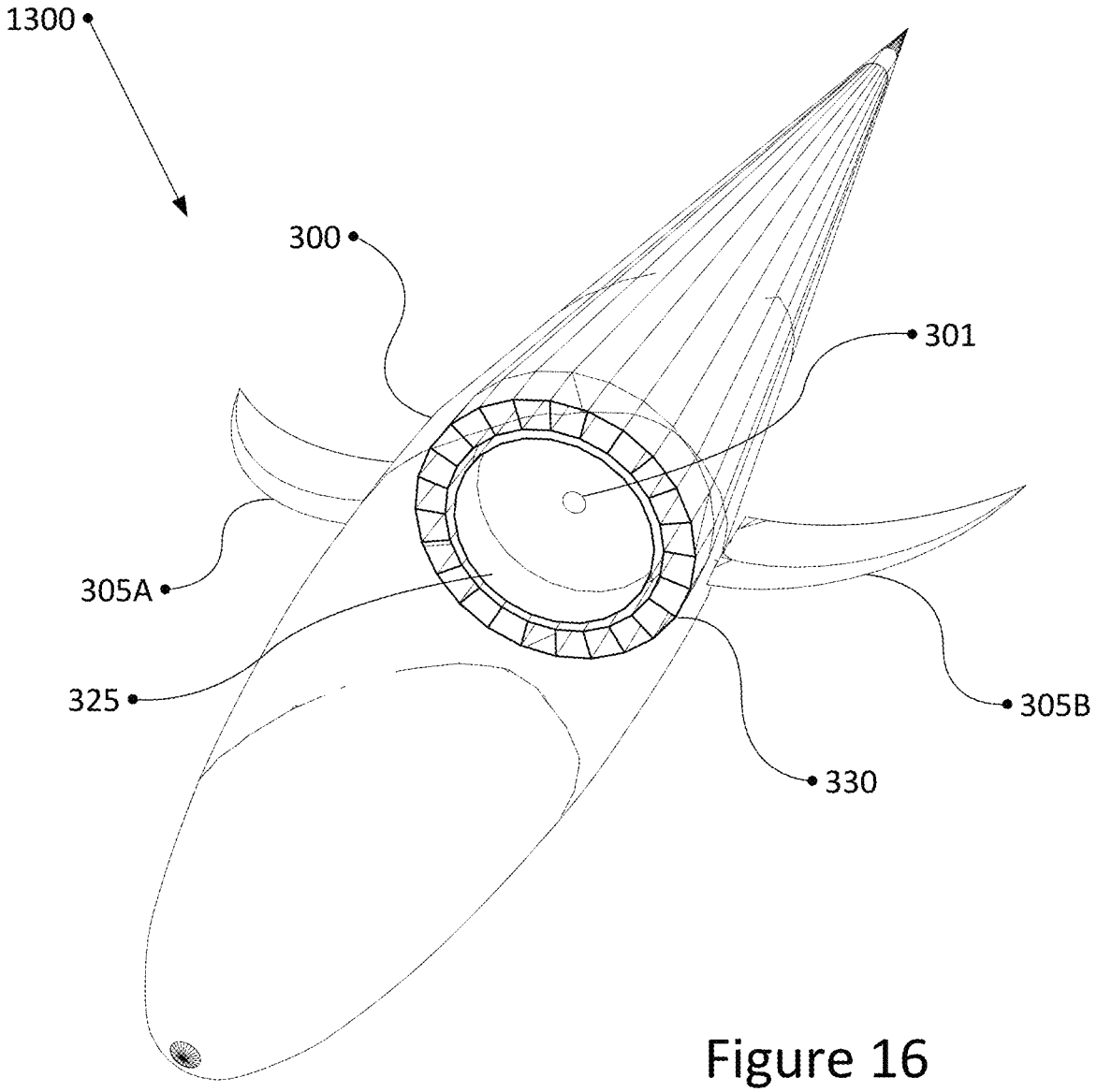
FIG. 16 illustrates the Fishboat of FIG. 13, further illustrating a TRE within the Fishboat with a section cut along the Transverse Axis.

FIG. 16 illustrates Fishboat 1300, further illustrating the TRE within Fishboat 1300 with a section cut along the Transverse Axis 315 of the TRE. Labeled are Spinner Inertial Mass 330, Spinner Motor 325, and Sensor Hole 301, which may extend into and even through Fishboat 1300. Sensors, cameras and the like may be located in Sensor Hole 301.

Figure 17:
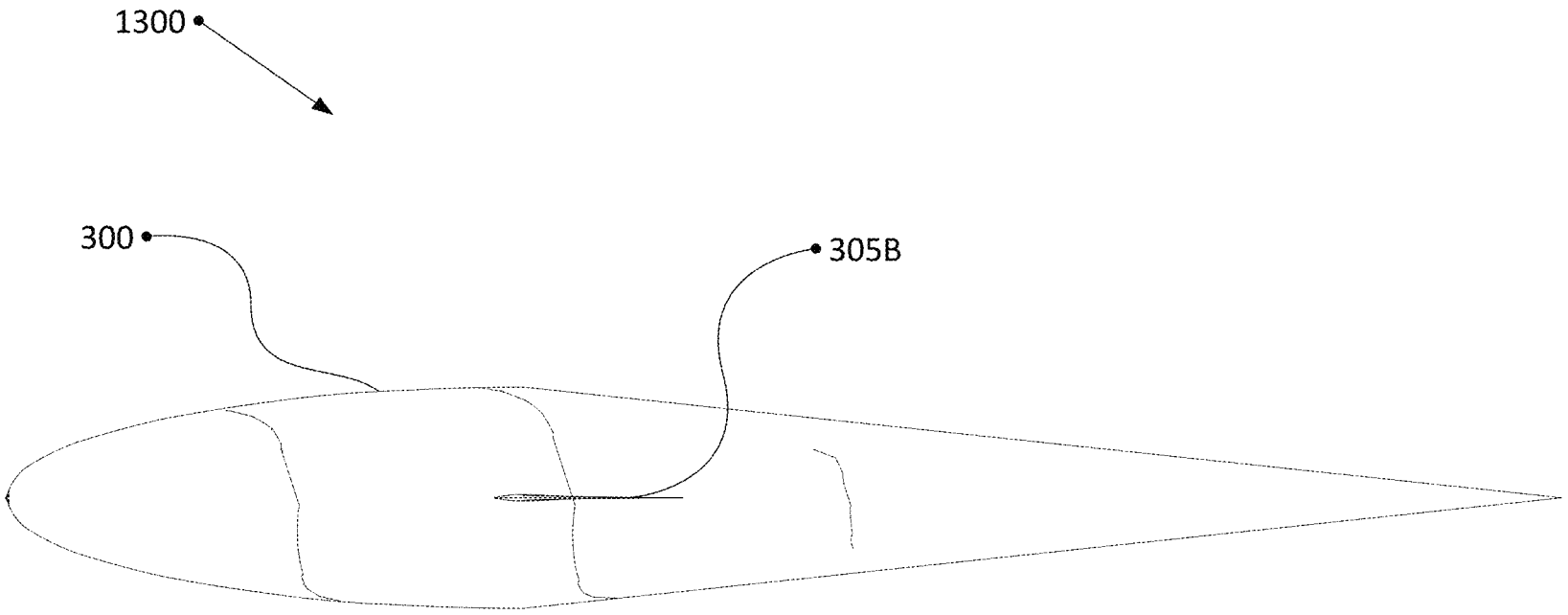
FIG. 17 illustrates the Fishboat of FIG. 13 in a side elevation parallel projection view.

FIG. 17 illustrates Fishboat 1300 in a side elevation parallel projection view, with Spinner Hull 300 and Port Fin 305B labeled.

Figure 18:
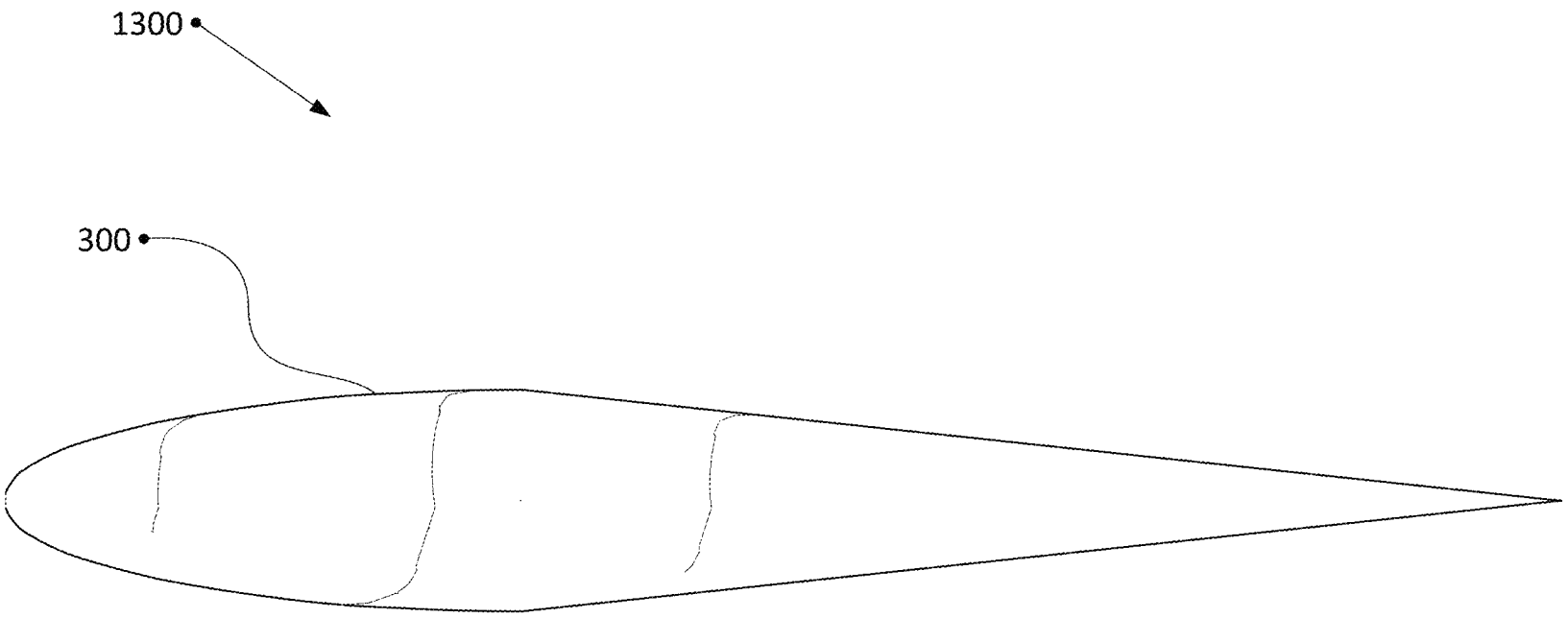
FIG. 18 illustrates an embodiment of a Hull interior of the Fishboat of FIG. 13 in the side elevation parallel projection view of FIG. 17.

FIG. 18 illustrates an embodiment of Hull 300 in the side elevation parallel projection view of FIG. 17, with a section cut along Horizontal Axis 320, illustrating the interior of Hull 300. Note that the graphical spiral lines on the exterior continue on the interior.

Figure 19:
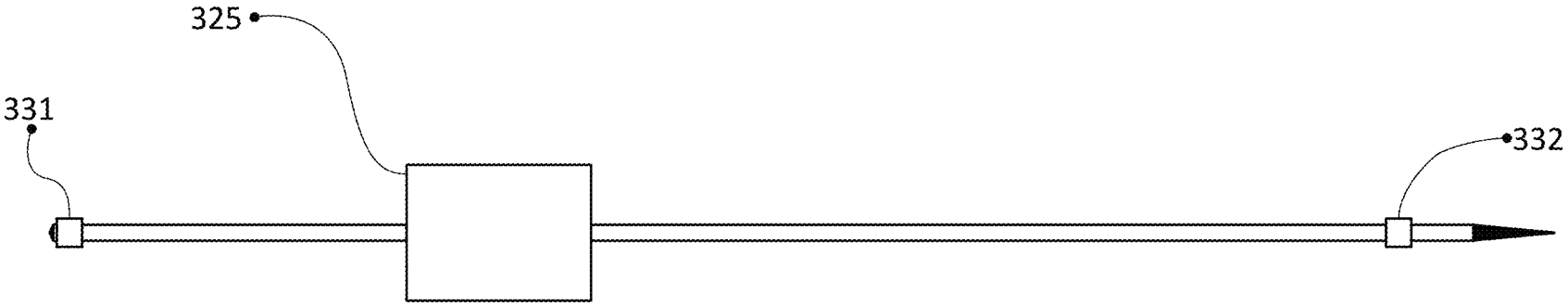
FIG. 19 illustrates an embodiment of a Stator Shell and Spindle of the Fishboat of FIG. 13 in the side elevation parallel projection view of FIG. 17.

FIG. 19 illustrates an embodiment of a Spinner Motor 325, Forward Bearing 331, and Aft Bearing 332, within the Fishboat of FIG. 13 in the side elevation parallel projection view of FIG. 17.

Figure 20:
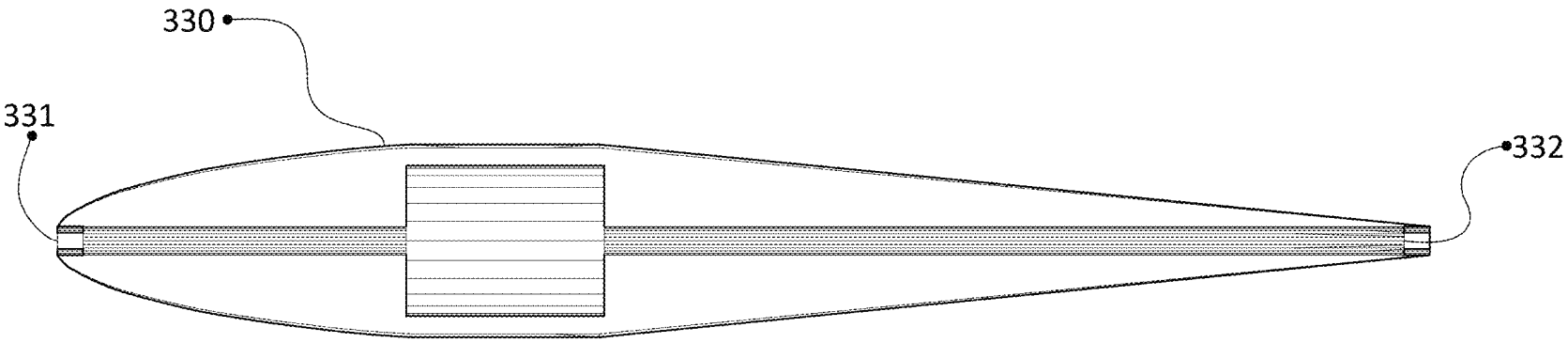
FIG. 20 illustrates an embodiment of an Inertial Mass and Rotor of the Fishboat of FIG. 13 in the side elevation parallel projection view of FIG. 17, with a section cut along the Horizontal Axis.

FIG. 20 illustrates an embodiment of an Inertial Mass 330 of Fishboat 1300 in the side elevation parallel projection view of FIG. 17, with a section cut along the Horizontal Axis. Forward Bearing 331 and Aft Bearing 332 are illustrated and labeled for continuity's sake.

Figure 21:
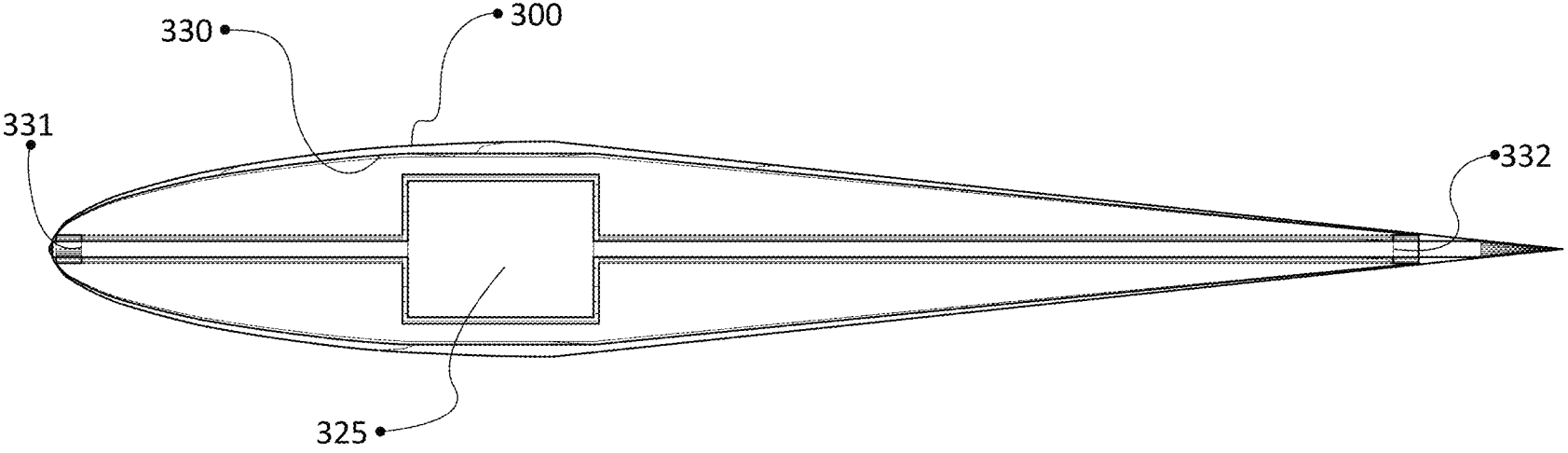
FIG. 21 illustrates the Fishboat of FIG. 13 in the side elevation parallel projection view of FIG. 17, with a section cut along the Horizontal Axis.

FIG. 21 illustrates Fishboat 1300 in the side elevation parallel projection view of FIG. 17, with a section cut along the Horizontal Axis, illustrating and labeling components discussed elsewhere. The air gap between Spinner Motor 325 and Spinner Inertial Mass 330 is visible.

Figure 22:
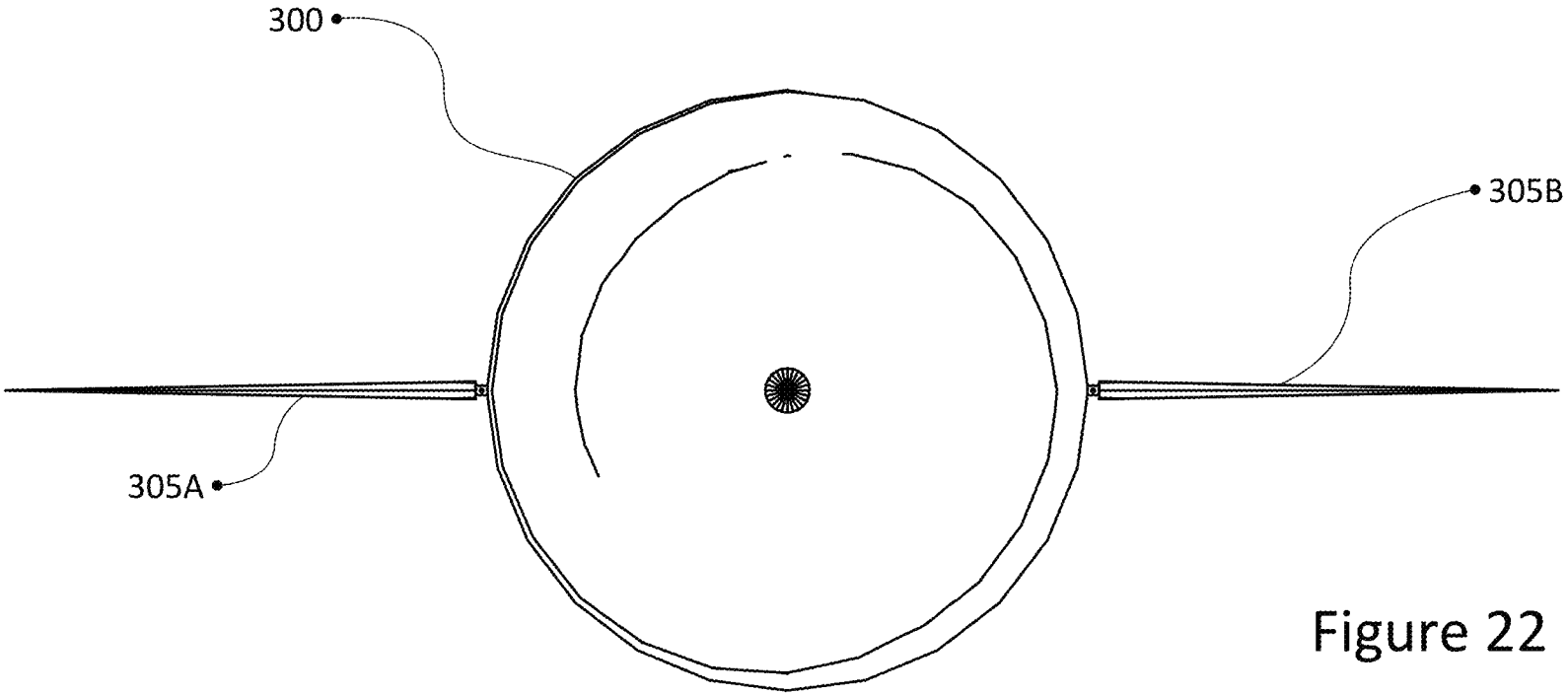
FIG. 22 illustrates the Fishboat of FIG. 13 in front elevation parallel projection view.

FIG. 22 illustrates Fishboat 1300 in front elevation parallel projection view.

Figure 23:
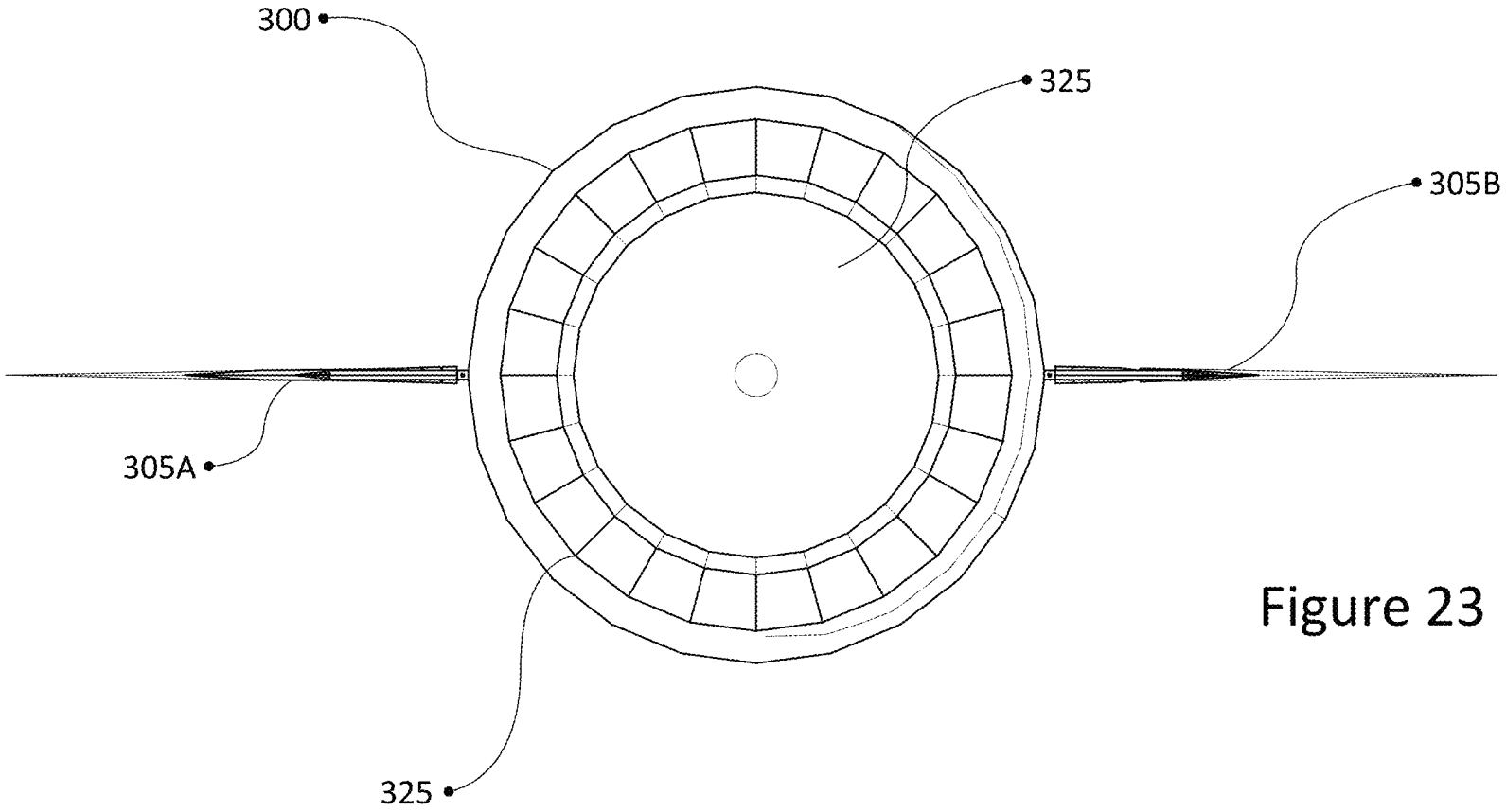
FIG. 23 illustrates the Fishboat of FIG. 13 in front elevation parallel projection view, with a section cut along the Transverse Axis.

FIG. 23 illustrates Fishboat 1300 in front elevation parallel projection view, with a section cut along the Transverse Axis 315.

Figure 24A:
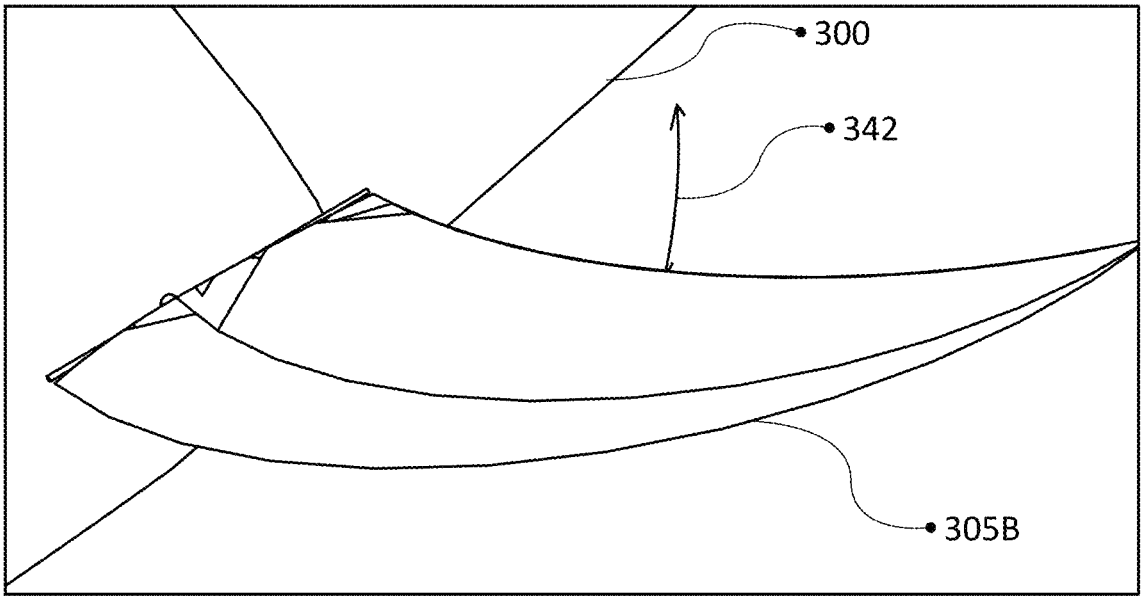
FIG. 24A illustrates a close perspective view of a Fin embodiment.
Figure 24B:
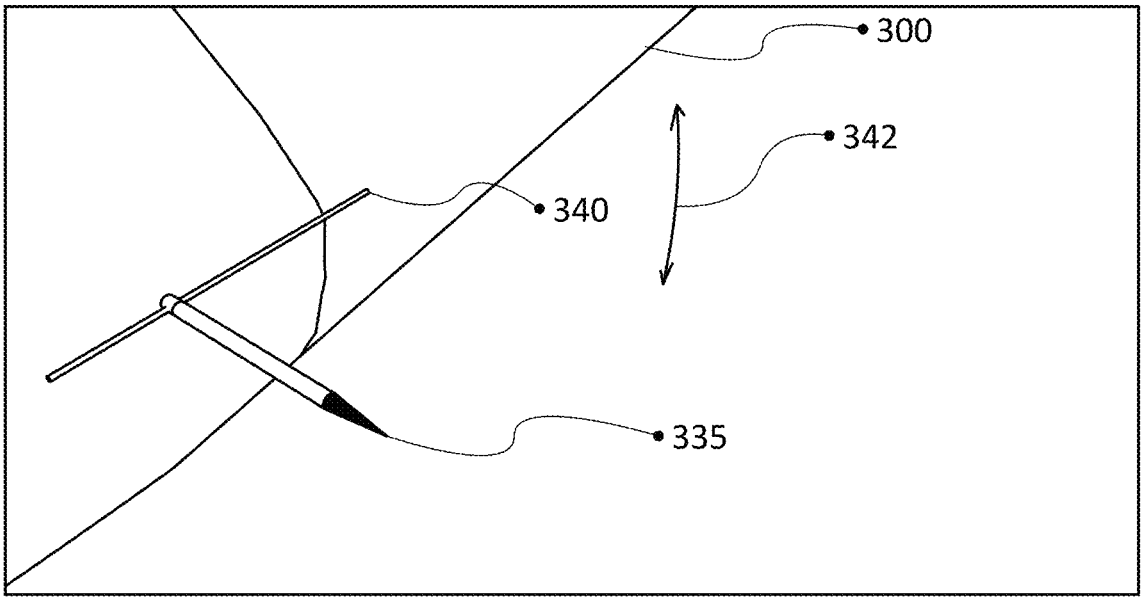
FIG. 24B illustrates the close perspective view of the Fin embodiment of FIG. 24A, with the Fin not shown to illustrate an embodiment of Fin-Flex Adjustment components.

FIG. 24A illustrates a close perspective view of a Fin 305B embodiment. FIG. 24B illustrates the close perspective view of FIG. 24A, with Fin 305B not shown to illustrate an embodiment of Fin-Flex Adjustment components. Similar to Flexible Beam, Fin-Flex Adjustment components allow the Fin to achieve an angle of attack which produces thrust. In the embodiment illustrated in FIGS. 24A and 24B, a Spinner Fin Rod 335 is attached to Spinner Hull 300, generally at the center of displacement of Spinner Hull 300. Spinner Fin Rod 335 penetrates Fin 305B, generally at the center of displacement of Fin 305B. In this illustration, Fin 305B rotates about Spinner Fin Rod 335, generally with low resistance, generally along Arrow 342. This may be facilitated by bearings, which may include a simple brass-on-brass bearing surface between Fin 305B and Spinner Fin Rod 335. As the Spinner Hull 300 rolls about Horizontal Axis 320, first one way and then the other (in reaction to torque produced by Spinner Motor 325 as Spinner Motor 325 rotates Spinner Inertial Mass 330), Fin 305B will rotate about Spinner Fin Rod 335 and will find a path of least resistance through the thrust fluid (water) and will not produce thrust. However, if Fin 305B is also secured to Spinner Fin Spring 340, Spinner Fin Spring 340 retards deflection, prevents Fin 305B from following the path of least resistance, and causes Fin 305B to generate thrust. The bending modulus of Spinner Fin Spring 340 may be adjustable. The attachment location of Fin 305B to Spinner Fin Rod 335 may be adjustable, so as to move Fin 305B forward and back relative to Spinner Fin Rod 335, which may be done to change the angle of attack achieved by Fin 305B.

Figure 25A:
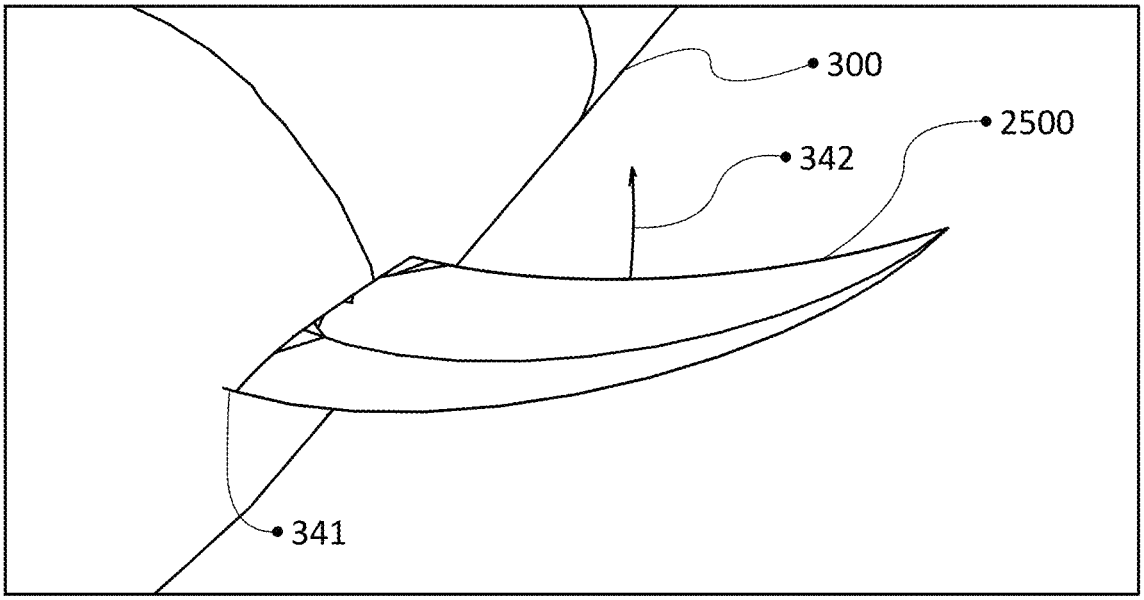
FIG. 25A illustrates a close perspective view of a Fin embodiment.
Figure 25B:
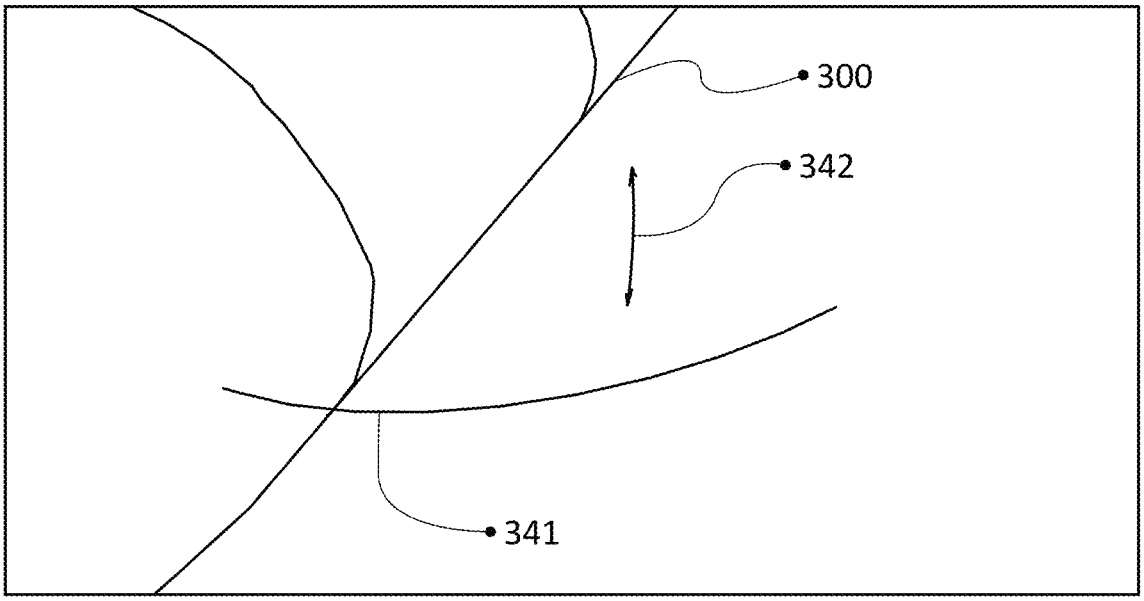
FIG. 25B illustrates the close perspective view of the Fin embodiment of FIG. 25A, with the Fin not shown to illustrate an embodiment of Fin-Flex Adjustment components.

FIG. 25A illustrates a perspective view of a Fin 2500 embodiment. FIG. 25B illustrates the perspective view of FIG. 25A, with Fin 2500 not shown to illustrate another example of Fin-Flex Adjustment components, which does not involve a bearing surface (between Fin and Spinner Fin Rod). In the embodiment illustrated in FIGS. 25A and 25B, Fin 2500 may be attached to the Spinner Hull forward of the center of displacement of the Fin, such as at Spinner Fin-Spring-Rod 341. Spinner Fin-Spring-Rod 341 comprises a bending modulus. Fin follows a path similar to that described above (it would be prevented from following the path of least resistance by Spinner Fin-Spring-Rod 341) and generates thrust, generally along Arrow 342. The bending modulus of Spinner Fin-Spring-Rod 341 may be adjustable, so that the amount of thrust can be varied.

Figure 26A:
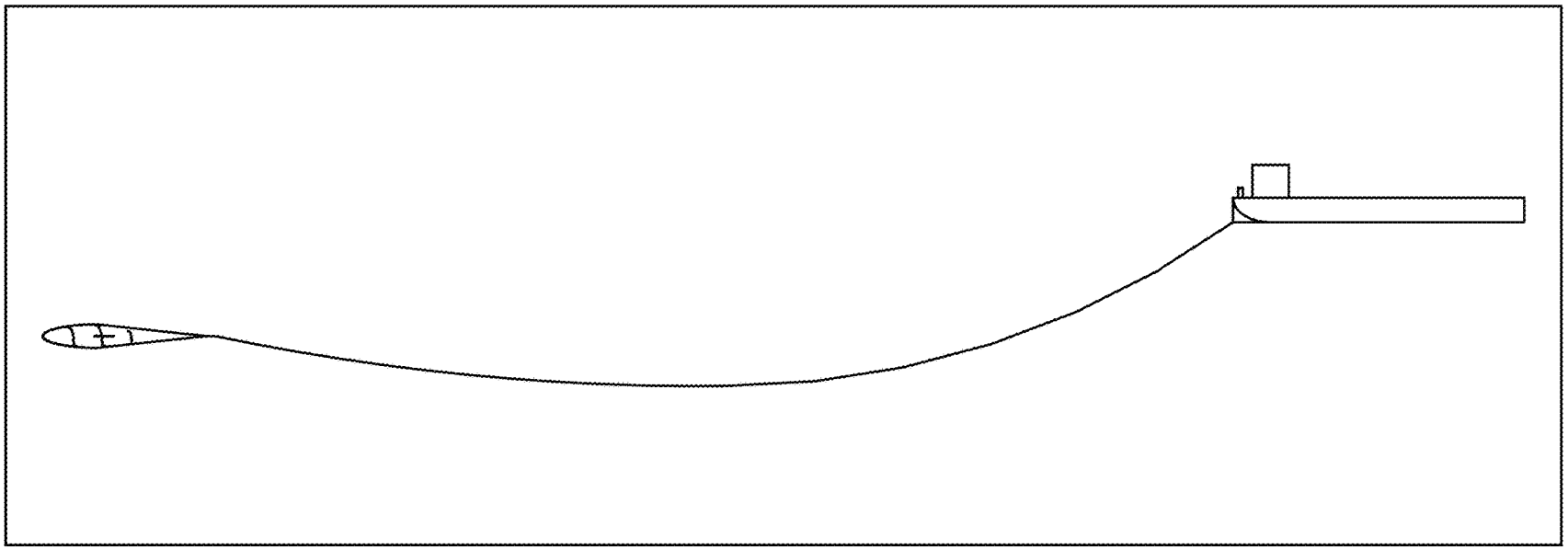
FIG. 26A illustrates the Fishboat of FIG. 13 attached to a Barge via a Hawser.
Figure 26B:
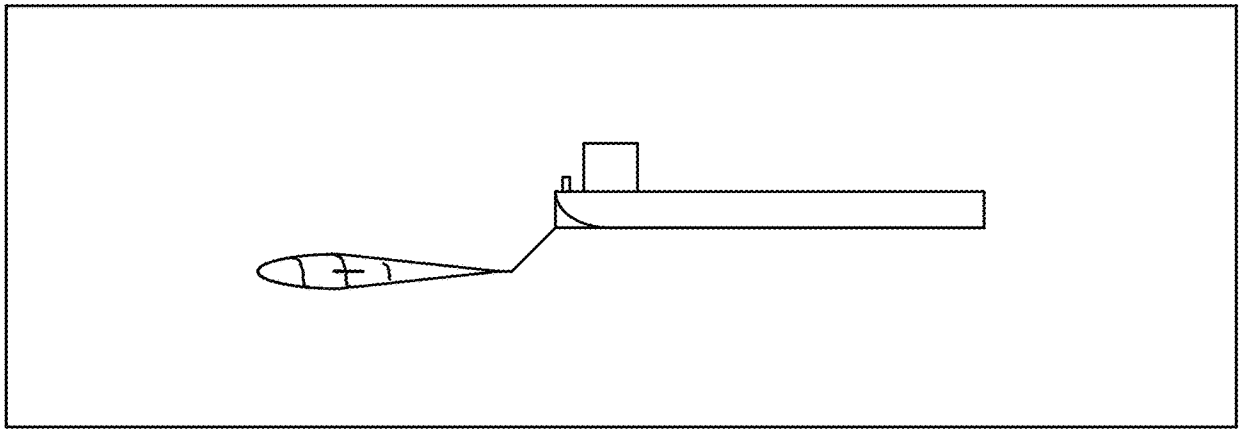
FIG. 26B illustrates the Fishboat of FIG. 13 attached to a Barge via a Whisker Pole.

FIG. 26A illustrates the Fishboat of FIG. 13 attached to a Barge via a Hawser. The securement between the Fishboat and the Hawser may comprise a bearing to allow the Fishboat to oscillate with less resistance. FIG. 26B illustrates the Fishboat of FIG. 13 attached to a Barge via a Whisker Pole. The Hawser or Whisker Pole may supply power to the Fishboat.

Figure 27A:
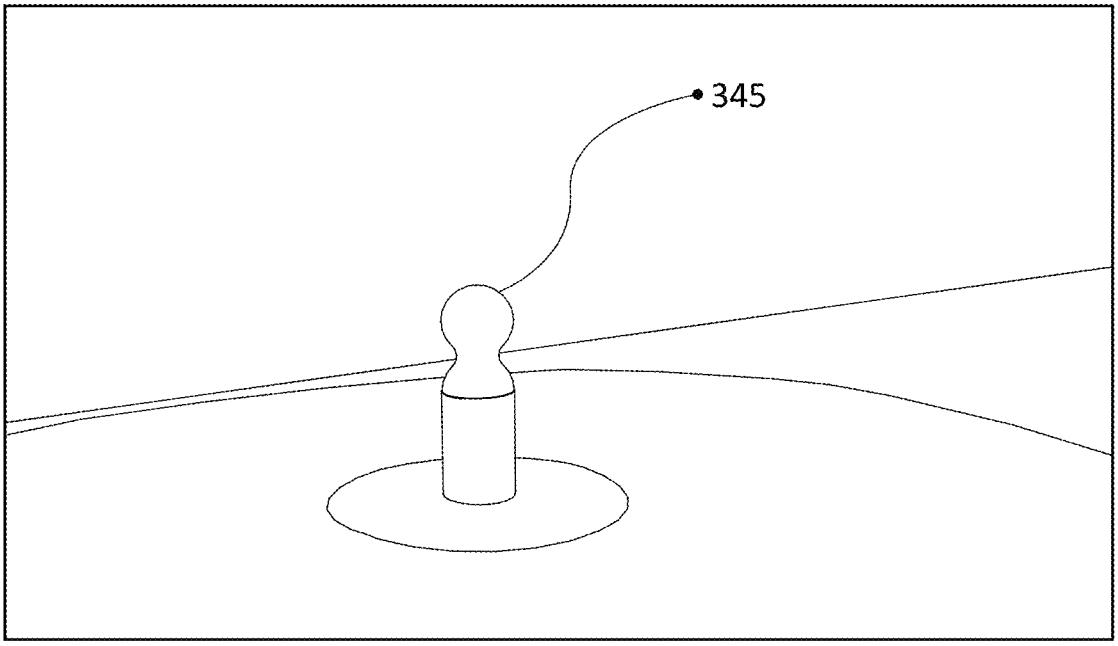
FIG. 27A illustrates a detail perspective view of an embodiment of a connection point for a Harness.
Figure 27B:
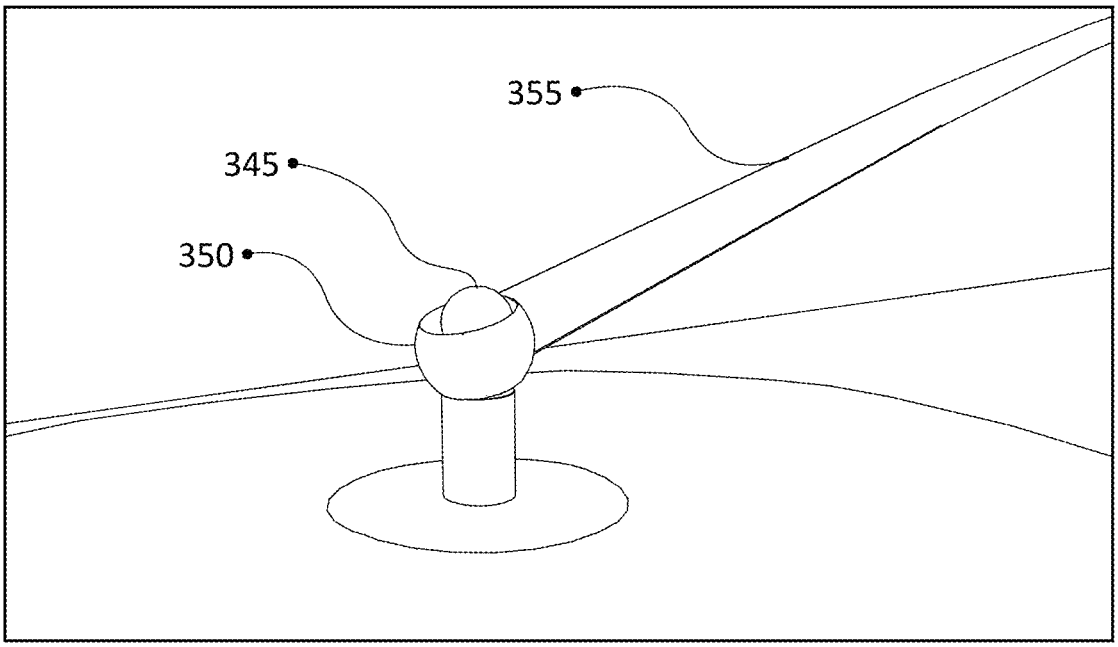
FIG. 27B illustrates the detail view of FIG. 26A, further comprising Harness components.

FIG. 27A illustrates an embodiment of a Hitching Post 345 projecting through the approximate center of displacement of a Fishboat embodiment. FIG. 27B illustrates an embodiment of Collar 350 on a Harness 355 secured to Hitching Post 345. The bending modulus of the Harness 355 may be sufficient to accommodate cyclic counter-rotation ("oscillation") of the Fishboat while securing the Fishboat to a Harness. Facilitating this, the Harness may comprise a portion such as a flexible cord, strap, chain or the like, which portion is secured to Hitching Post 345 or an equivalent structure.

Figure 28A:
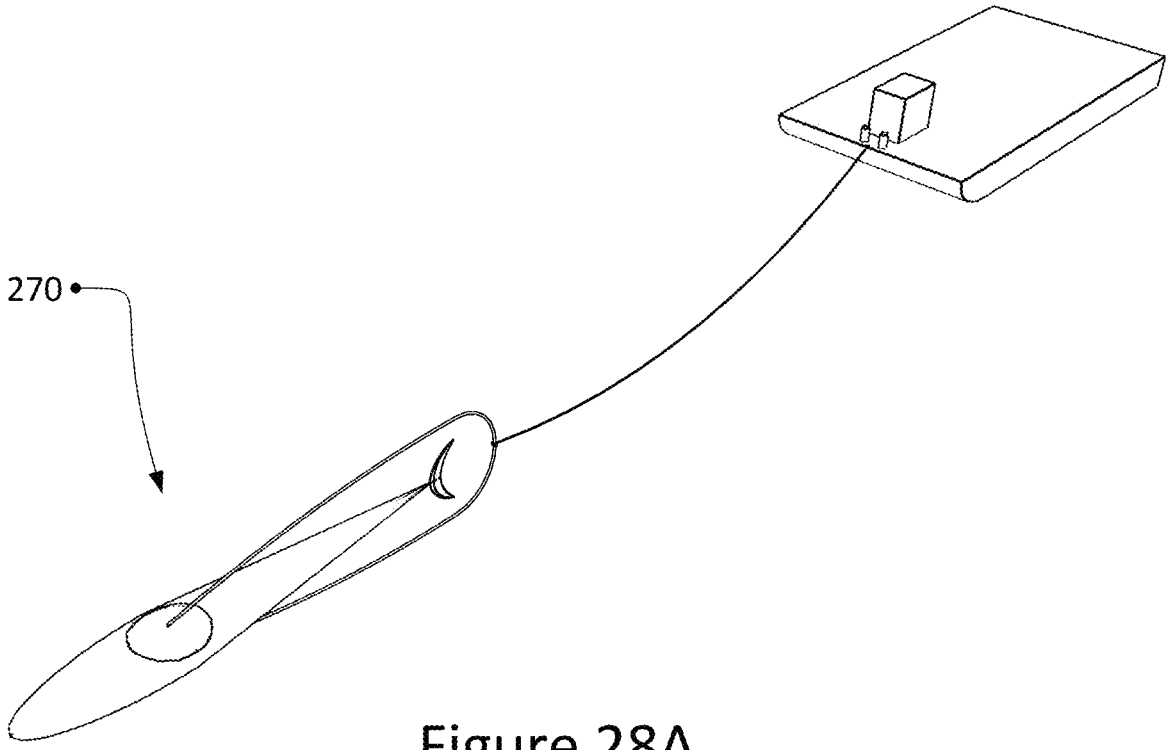
FIG. 28A illustrates an embodiment of a Direct Drive Craft.
Figure 28B:
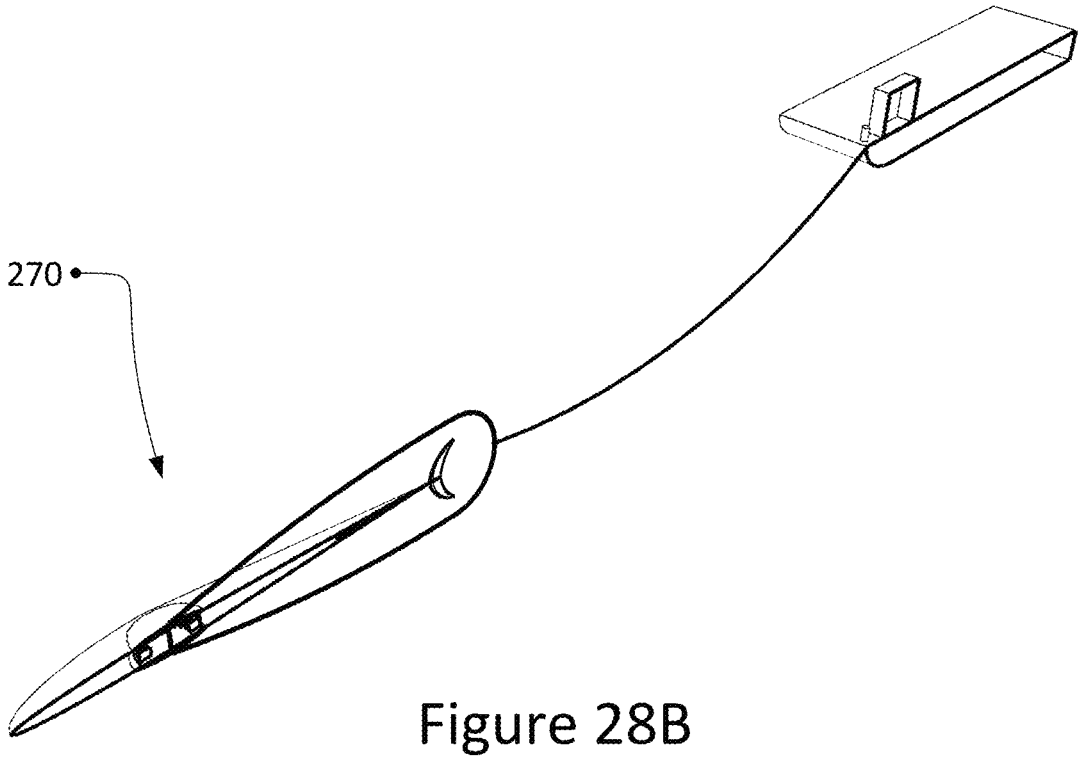
FIG. 28B illustrates the Direct Drive Craft of FIG. 27A with a section cut through the Horizontal Axis.
Figure 29:
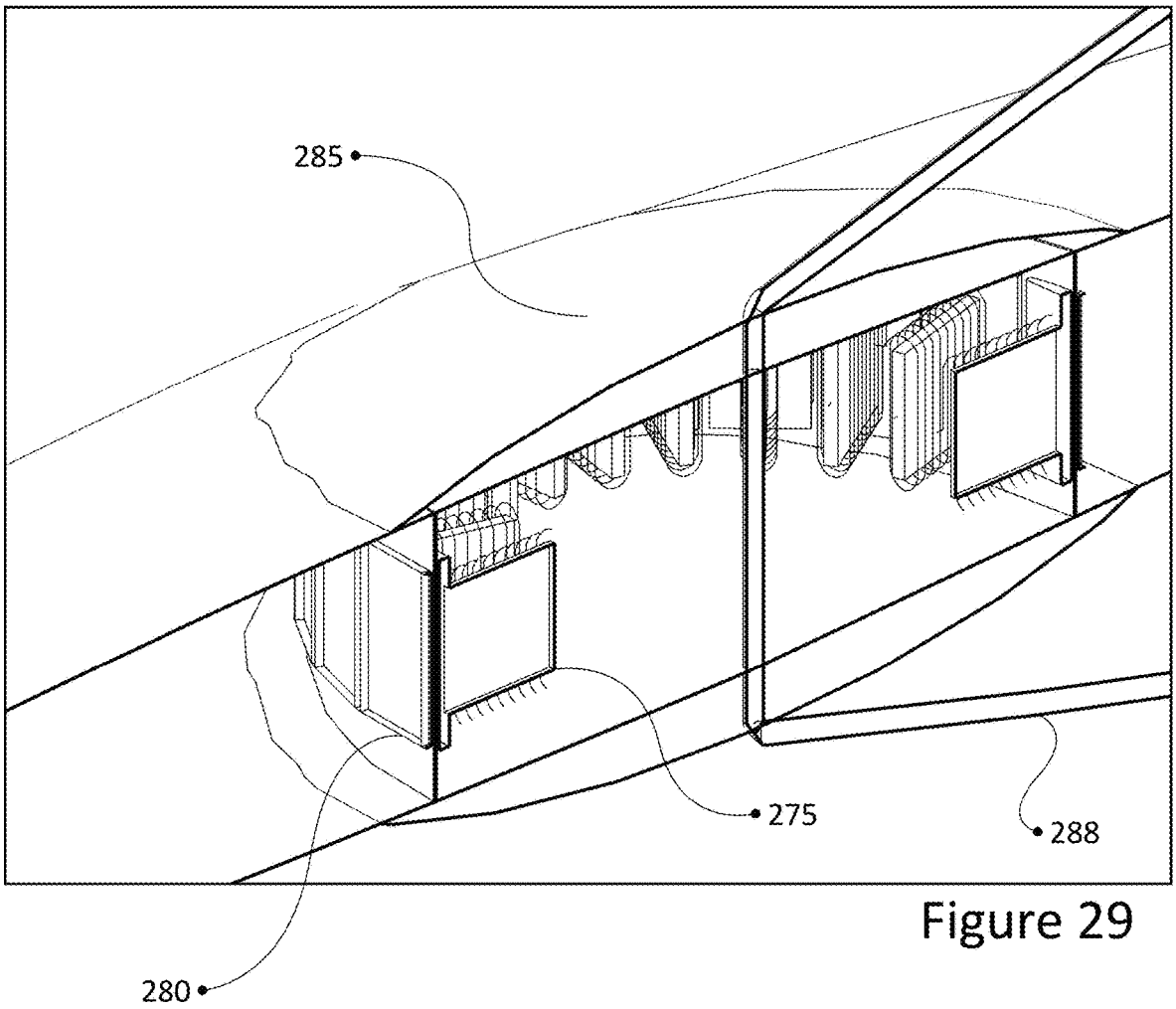
FIG. 29 illustrates a detail of the Direct Drive Craft of FIG. 26A with a section cut through the Horizontal Axis.

FIG. 28A illustrates an embodiment of a Direct Drive Craft 270. FIG. 28B illustrates the Direct Drive Craft 270 of FIG. 28A with a section cut through the Horizontal Axis. FIG. 29 illustrates a detail of the Direct Drive Craft of FIG. 28A with a section cut through the Horizontal Axis. The following components in Direct Drive Craft 270 are labeled: Direct Drive ("DD") Stator 275, DD Rotor 280, Membrane 285, and Harness 288. DD Stator 275 and DD Rotor 280 are separated by a gap. A bearing, not illustrated, supports components which are part of DD Rotor 280 relative to DD Stator 275. Membrane 285 may protect the gap between DD Stator 275 and DD Rotor 280. Membrane 285 must be flexible to tolerate oscillation of DD Rotor 280 relative to Harness 288.

FIG. 30 illustrates an embodiment of a circuit or set of circuits which may be used to control a TRE and a Fishboat or a Direct Drive Craft. Motor 400 comprises a TRE or, for example, DD Stator 275 and DD Rotor 280. Power Source 110 is equivalent to the Power Source discussed elsewhere and may be, for example, a generator, battery, and the like.

Electric power from Power Source 110 may be connected to Energy Transfer Circuit 415 through the Harness or through power lines which exit the Harness or, when Inertial Mass comprises a Power Source or Capacitor, through, for example, Forward Bearing 331 and Aft Bearing 332 or through a contact provided for this purpose. Between Energy Transfer Circuit 415 and Power Transfer Circuit 420 may be found Capacitor 180 which, as noted elsewhere, may be a capacitor, a battery, or another power reservoir. Power exits Capacitor 180 and enters Power Transfer Circuit 420, which may incorporate or be connected to Rectifier 178, which may communicate power, such as three-phase power, to TRE or Motor 400. Three lines are illustrated in FIG. 30 to illustrate three-phase power. Three-phase power may be delivered in the form of a pulse-code modulated signal regulated by Control Circuit 425 and output by Power Transfer Circuit 420. Sensors-Actuators 430 may comprise, for example, Hall Sensors 201, Deflection Sensor-Actuator 247, strain, bend, or deflection sensors in Spinner Fin-Spring Rod 341 (and the like), position-orientation sensors, and sensors and actuators in the Power Source, in steering mechanisms, and the like.

Motor 400, Power Transfer Circuit 420, Energy Transfer Circuit 415, Power Source 110, Capacitor 180, and Sensors-Actuators 430 may communicate with or form among them Control Circuit 425. Control Circuit 425 may provide power to Motor 400, rotating Inertial Mass first in one direction, then the other.

Control Circuit 425 may control Motor 400 across a drive phase and a brake phase, which phases are repeated to produce thrust. Control Circuit 425 may, for example, detect the angle of attack or an indicator of the angle of attack of a Fin (such as a bend in a Flexible Beam) and, based on the angle of attack, may instruct Power Transfer Circuit 420 to drive Motor 400 to accelerate the Inertial Mass in a drive phase, causing a torque reaction against a stator, which is torque is communicated to the Fin (such as via the Hull), which may cause the angle of attack of Fin to increase (or a bend in the Flexible Beam to increase), until a desired angle of attack of Fin is reached, at which point Control Circuit 425 may instruct Power Transfer Circuit 420 to apply an electronic brake to the Inertial Mass in a brake phase, causing a torque reaction against the stator opposite the torque experienced during the drive phase, which torque is communicated to the Fin, which may cause the angle of attack of the Fin to decrease. When the angle of attack returns to, for example, normal relative to the desired direction of travel of the craft, the drive phase may be engaged, with the process returning to the process outlined at the start of this paragraph. The Power Transfer Circuit 420 and Motor 400 may generate power during application of the electronic brake, which power may be transferred to Capacitor 180 for storage. Power from Capacitor 180 and Power Source 110 may be used during the drive phase. Other and/or additional feedback loops may be employed, such as a feedback loop based on available power in Capacitor 180, which may control, via Control Circuit 425, Energy Transfer Circuit 415 and power produced or supplied by Power Source 110.

The drive phase may bring the Inertial Mass up to a rotational speed of X, while the brake phase may reduce the rotational speed to Y, wherein Y remains a positive number (the brake phase may not fully stop the Inertial Mass).

There are four possible modes or quadrants of operation using a DC motor, brushless or otherwise. In an X-Y plot of speed versus torque, Quadrant I is forward speed and forward torque. The Torque is propelling the motor in the forward direction. Conversely, Quadrant III is reverse speed and reverse torque. Now the motor is "motoring" in the reverse direction, spinning backwards with the reverse torque. Quadrant II is where the motor is spinning in the forward direction, but torque is being applied in reverse. Torque is being used to "brake" the motor, and the motor is now generating power as a result. Finally, Quadrant IV is exactly the opposite. The motor is spinning in the reverse direction, but the torque is being applied in the forward direction. Again, torque is being applied to attempt to slow the motor and change its direction to forward again. Once again, the motor is generating power.

Another example of sensors and actuators which may be part of Sensors-Actuators 430 comprise acoustic sensors and actuators, such as microphones and vibratory sources.

A thrust fluid propulsion system may be used to propel a watercraft, aircraft, or land-based craft. The propulsion system and/or craft may be used to pull or push a human or another object.

In this example, the thrust fluid propulsion system comprises a motor comprising a rotor and a stator. In this example (the components may be reversed), the rotor is connected to the interior of a pressure vessel. The stator carries an inertial mass, such as a mass, such as a ring of lead, iron, or the like, a battery, such as a pack of batteries. The stator also carries an electronic speed controller ("ESC"), to control the motor. The ESC cyclically changes the relative acceleration of the rotor and inertial mass. The alternating torque reaction between the rotor and stator (produced as the inertial mass of the batteries and ESC and motor mass is accelerated and decelerated), produces a "torque reaction engine" ("TRE"), such as TRE 501 in FIG. 32. The alternating rotational force from the torque reaction engine is communicated to nose and tail plates and then to a fin, fluke, wing, or blade (hereinafter, "fluke"). Translation of the fluke up and down (or side-to-side or clockwise and counterclockwise) accelerates thrust fluid and produces thrust.

An angle of attack of the fluke may be variable. For example, at slow speed relative to the surrounding fluid (understood to include a gas), the angle of attack may be relatively high, such as 20 to 30 or more degrees, relative to normal. For example, at high speed relative to the surrounding fluid, the angle of attack may be relatively low, such as 5 to 20 degrees.

An allowed fluke angle of attack may be varied, such as by mounting the fluke on a flexible beam and allowing or forcing the flexible beam to extend or withdraw within a rigid channel. When extended, the flexible beam may allow a larger angle of attack. When withdrawn, the flexible beam may allow a smaller angle of attack.

Powered mechanisms may be used to change the allowed fluke angle of attack, such as to withdraw or extend the flexible beam. For a craft that changes speed often and/or that encounters environmental pressure gradients (waves), it may be desirable to change the allowed fluke angle of attack often or even continuously. Creating a mechanism that can reliably and efficiently change the allowed angle of fluke attack often or continuously and providing power to such a mechanism is a complex problem that may result in inefficiencies and reduced reliability.

When a fluke propels thrust fluid, the fluke experiences at least one of drag, lift and thrust. These forces may be combined in one vector (often lumped together as "thrust"), that pushes the fluke forward and propels the watercraft. Feedback between speed of craft, speed of oscillation of the fluke through the thrust fluid, and allowed fluke angle of attack may be used to maximize thrust production. Strohal number or other metrics may be used in an instrumented approach to maximizing thrust production (in an instrumented approach, one or more environmental and craft conditions are measured and a powered component varies the allowed fluke angle of attack).

A common belief among researchers studying fish-like propulsion is that thrust produced by a fin on a fish or marine mammal is not continuous; it is commonly believed to be discontinuous or pulsatile. It is common for researchers to believe that maximum thrust is produced when the fluke traverses the middle of its excursion, directly behind the fish and that minimal thrust is produced when the fluke is at the ends of its excursion, as the fluke reverses direction. For example, such beliefs were expressed at, "Marine Propulsion and Design: Inspirations from nature TechSurge", Jul. 19-21, 2017.

However, experiments with fin-powered watercraft by the inventor of the present patent application indicate that thrust production with a fin can be continuous. When oscillation of a fluke or wing is "too slow", thrust production is pulsatile. When such oscillation is sped up, thrust production smooths out and becomes continuous.

Though thrust produced by a fin-propelled craft may be measured and parameters of operation may be varied to result in continuous thrust production, it is still an inventive leap to realize that the combination of force vectors on a fin may result in a continuous thrust force on the fluke and that this thrust force may be used to power a passive mechanism to dynamically change the allowed fluke angle of attack.

A passive mechanism to dynamically change the allowed fluke angle of attack based on and using power from thrust produced by the fluke may increase overall efficiency, reliability, or improve another desirable performance indicator of a craft that utilizes a fluke or blade.

FIGS. 32-40 illustrate examples of passive and/or active angle of attack control mechanisms for fin-based watercraft or thrust fluid propulsion system.

Figure 32:
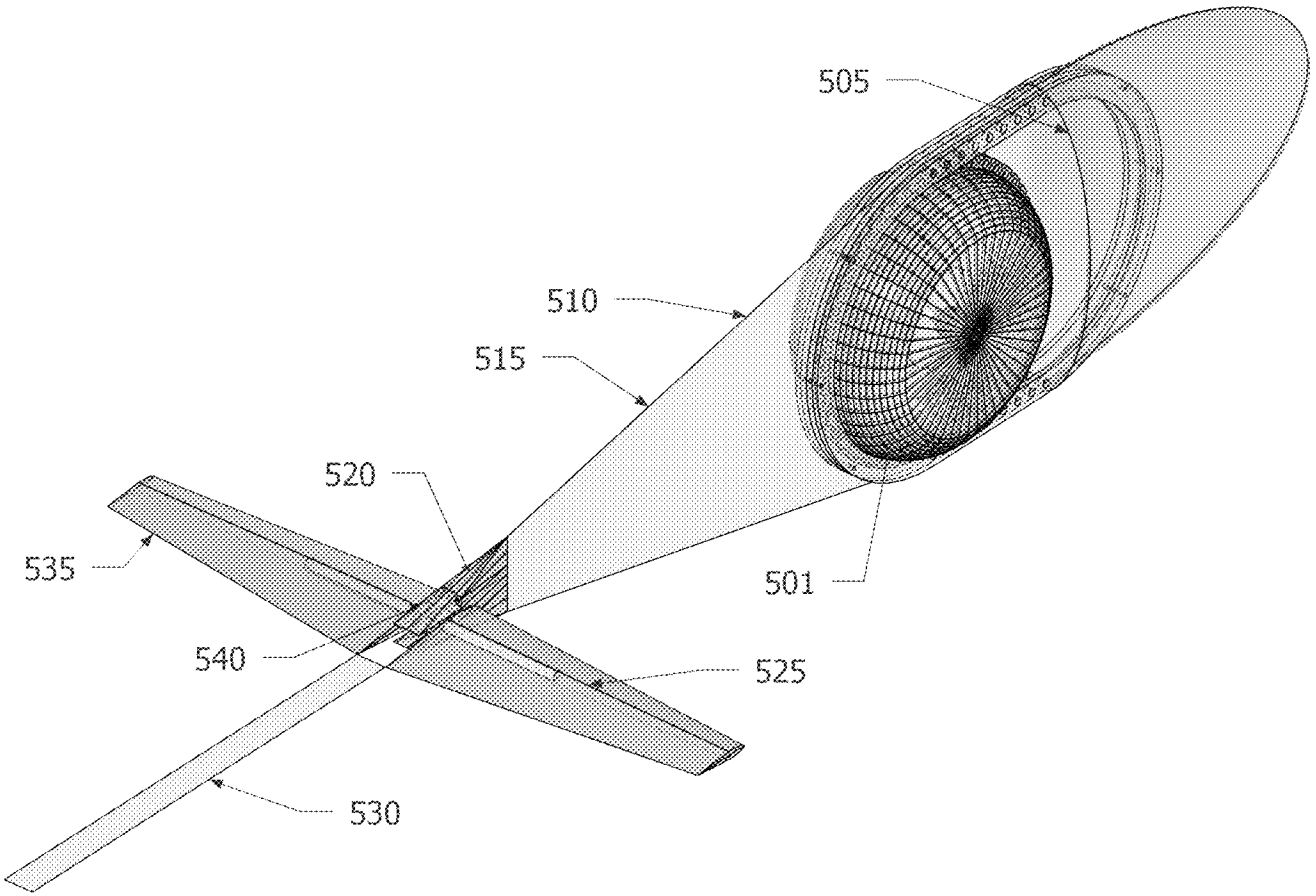
FIG. 32 is a first embodiment of a passive and/or active angle of attack control mechanism.

In FIG. 32, a watercraft or "phish" 510 comprises TRE 501. The TRE causes a hull plate to oscillate. Oscillation of the hull plate causes a fluke to translate through a surrounding thrust fluid. The watercraft further comprises displacement, nose 505, full plate, aft section 515, fluke clasp 520, fluke center of displacement ("CoD") 525, angle of attach (AoA) ribbon, single 530, fluke 535, and rotational junction 540.

The fluke 535 may comprise a rod. The rod may be located at a center of displacement ("CoD") of the fluke. The rod may be secured to the craft by a bearing. Together, the rod and bearing may be referred to herein as a rotational junction 540. When a wing (or fluke) is held by a rotational junction at its CoD and is translated through the surrounding thrust fluid, the wing rotates about the rotational junction and will find its path of least resistance through the thrust fluid (a neutral angle of attack) and will produce drag, but not lift or thrust. An external force that resists rotation of the wing about the rotational junction may cause the wing to have an angle of attack that may cause the wing to develop lift and/or thrust.

As disclosed herein, external force to resist rotation of the wing about the rotational junction may be provided by the wing, as the wing produces lift and/or thrust and/or by a source of drag. To increase efficiency of generation of propulsive force, a high angle of attack is desired at slow speeds, whereas at high speed, a low angle of attack is desired. The lift and/or thrust generation of the wing and/or drag from the source of drag may therefore passively and continuously vary the angle of attack of the wing, producing efficient generation of propulsive force without an eternally powered actuator.

For example, in FIG. 32, an angle of attack ("AoA") ribbon 530 is secured to a trailing edge of the fluke 535. At slow speeds, the AoA ribbon 530 experiences relatively low drag and provides low resistance to rotation of the fluke 535 about the rotational junction 540, allowing the fluke to find a relatively high angle of attack. At higher speeds, the AoA ribbon 530 experiences relatively higher drag and provides greater resistance to rotation of the fluke 535 about the rotation junction 540, allowing the fluke 535 to find a relatively low angle of attack. If the fluke 535 is secured to the craft with a flexible tendon, rather than at the rotational junction 540, the AoA ribbon may function similarly.

Figure 33:
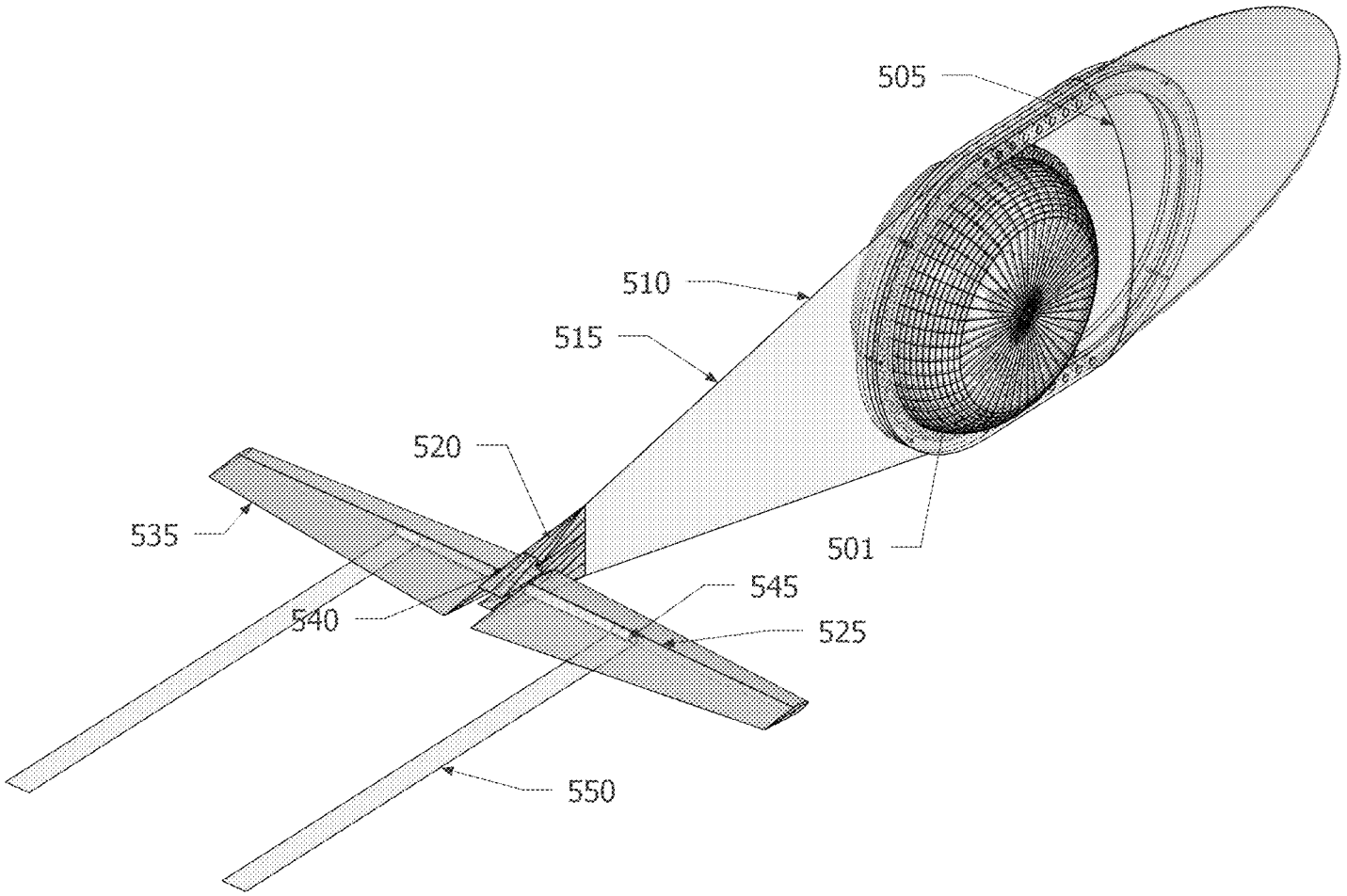
FIG. 33 is a second embodiment of a passive and/or active angle of attack control mechanism.

FIG. 33 illustrates two AoA ribbons 550 and a ribbon reel 545. The ribbon reel 545 may be used to extend and retract the AoA ribbon 550, to vary the amount drag on the AoA ribbon 550 and to vary the resistance to rotation of the fluke 535 about the rotational junction 540. The AoA ribbon 550 may have break-away sections and/or a cutter may be used to allow the AoA ribbon to separate from the craft, such as if it becomes entangled or if connection to the AoA ribbon is no longer desired.

Figure 34:
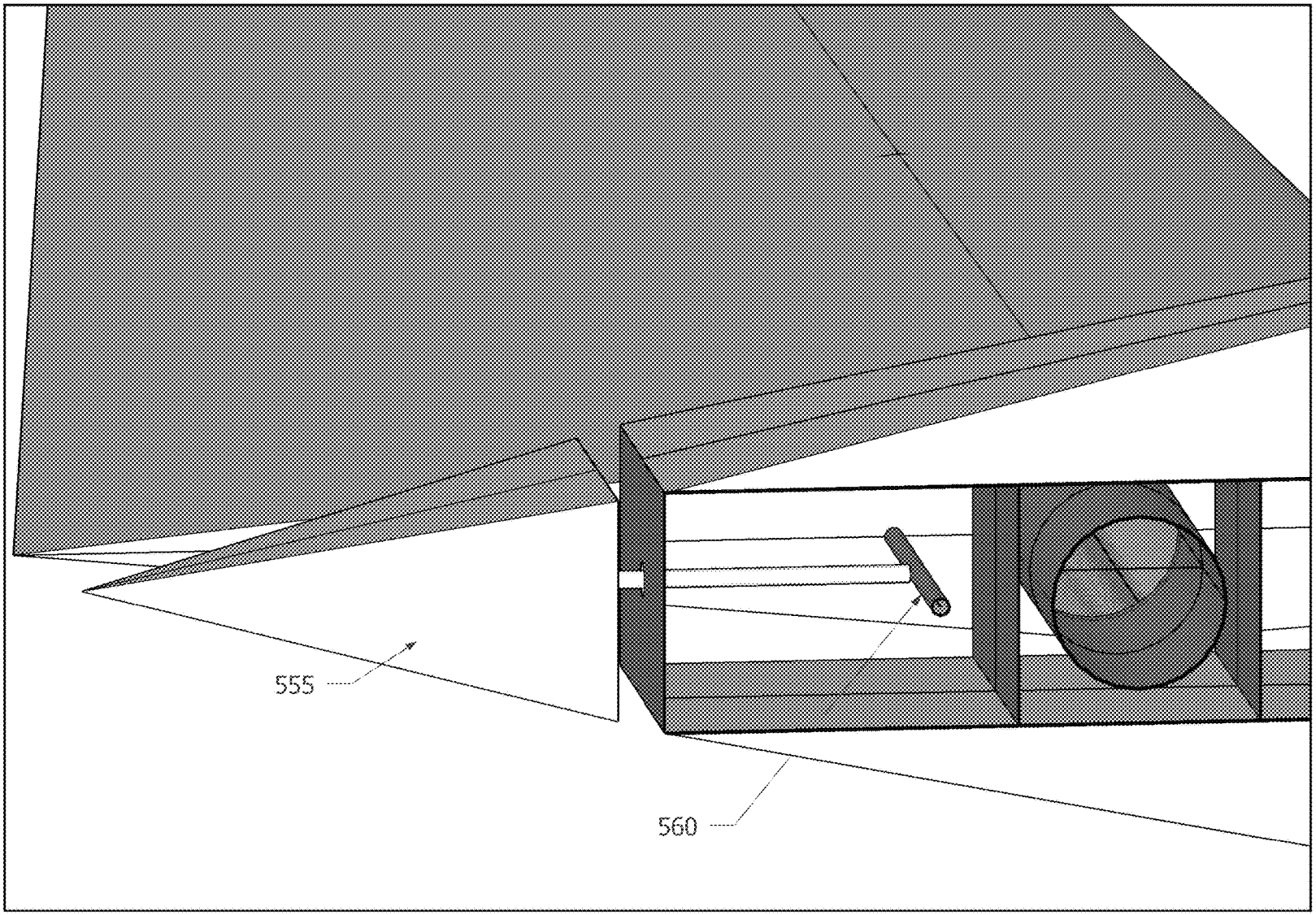
FIG. 34 is a third embodiment of a passive and/or active angle of attack control mechanism.

FIG. 34 illustrates an embodiment in which the two sides of the fluke are connected via a trailing fluke rod 560. The trailing fluke rod 560 may be rigid. The trailing fluke rod 560 may be attached to a drogue 555, such as by a cord. As the fluke rotates about the rotational junction 540, the drogue 555 may limit such rotation. The drogue 555 may experience lower drag at lower speed, allowing the fluke 535 to rotate further about the rotational junction 540. The drogue 555 may experience higher drag at higher speed, allowing the fluke to rotate less about the rotational junction 540.

Figure 35:
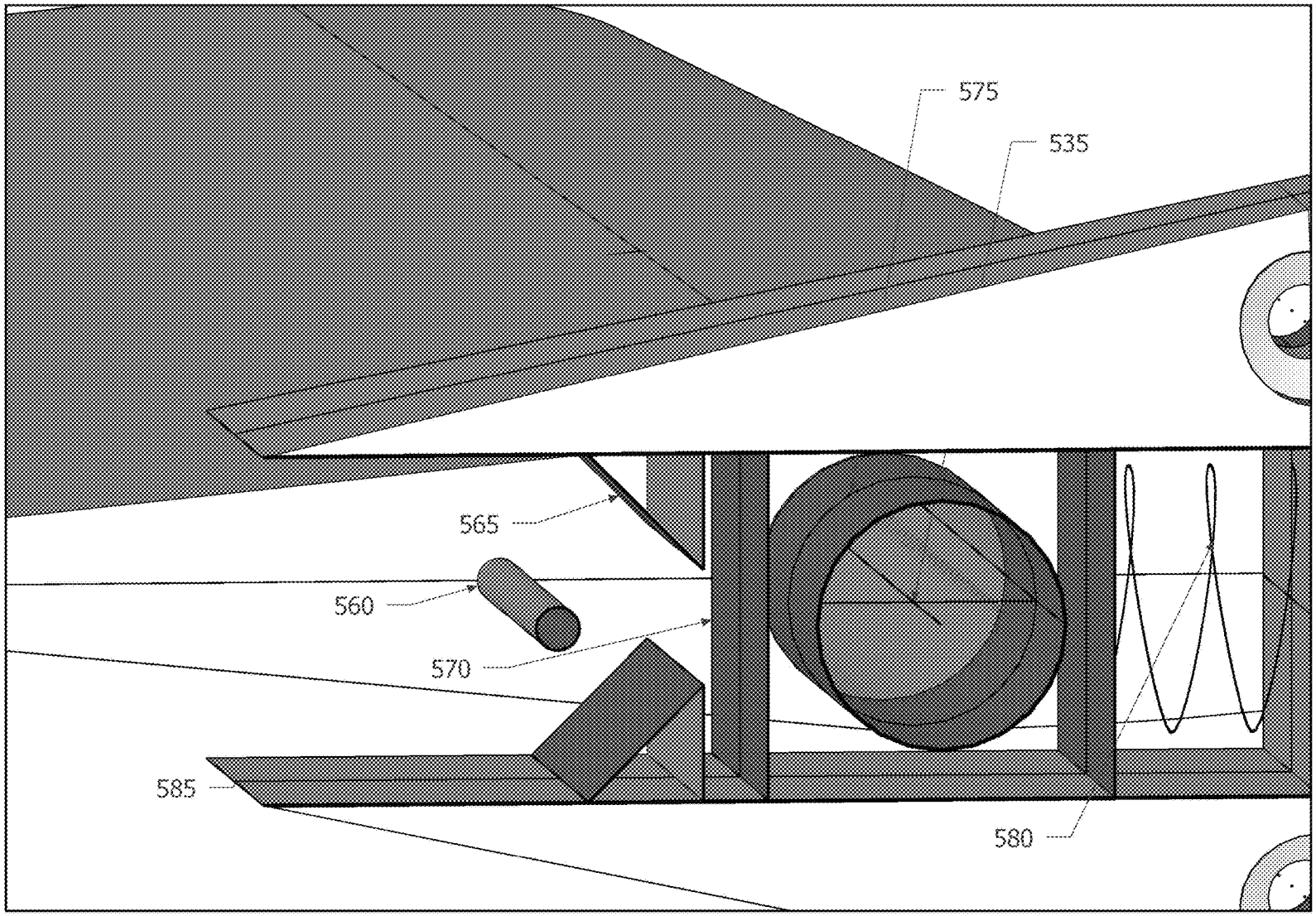
FIG. 35 is a forth embodiment of a passive and/or active angle of attack control mechanism.

FIG. 35 illustrates an embodiment in which rotation of the fluke about the rotational junction (comprising fluke bearing 575 and fluke bearing housing 570) is limited by rotation limiters 565 on the inside of the fluke clasp 585. The rotation limiters 565 are angled, such that as the rotational junction moves forward within fluke clasp 585, the space between the rotation limiter 565 narrows and the allowed rotation of the fluke about the rotational junction (due to interaction of the fluke trailing rod 560 and the rotation limiters 565) is reduced. The rotational junction may slide forward within the fluke clasp 585 due to thrust produced by the fluke. As thrust increases, the rotational junction moves further toward the remainder of the craft and the allowed rotation of the fluke about the rotational junction is reduced. As thrust decreases, the rotational junction moves away from the remainder of the craft and the allowed rotation of the fluke about the rotational junction is increased. Movement of the rotational junction may be caused by thrust produced by the fluke, which drives the fluke and rotational junction forward within the fluke clasp 585 against the spring 580. When thrust production reduces, the spring 580 may cause the rotational junction and fluke to move backward within the fluke clasp 585.

As illustrated in FIG. 35, the rotational junction may comprise, for example, a fluke bearing housing 570 that is able to slide fore and aft within the fluke clasp 585. The fluke bearing housing may comprise a fluke bearing 575. Within the fluke bearing may be a fluke rod. The fluke rod may connect the port and starboard sides of the fluke. The fluke rod may be located at a center of displacement ("CoD") of the fluke.

The spring 580 may be adjustable, may be fluid or gas filled, or the like.

Figure 36:
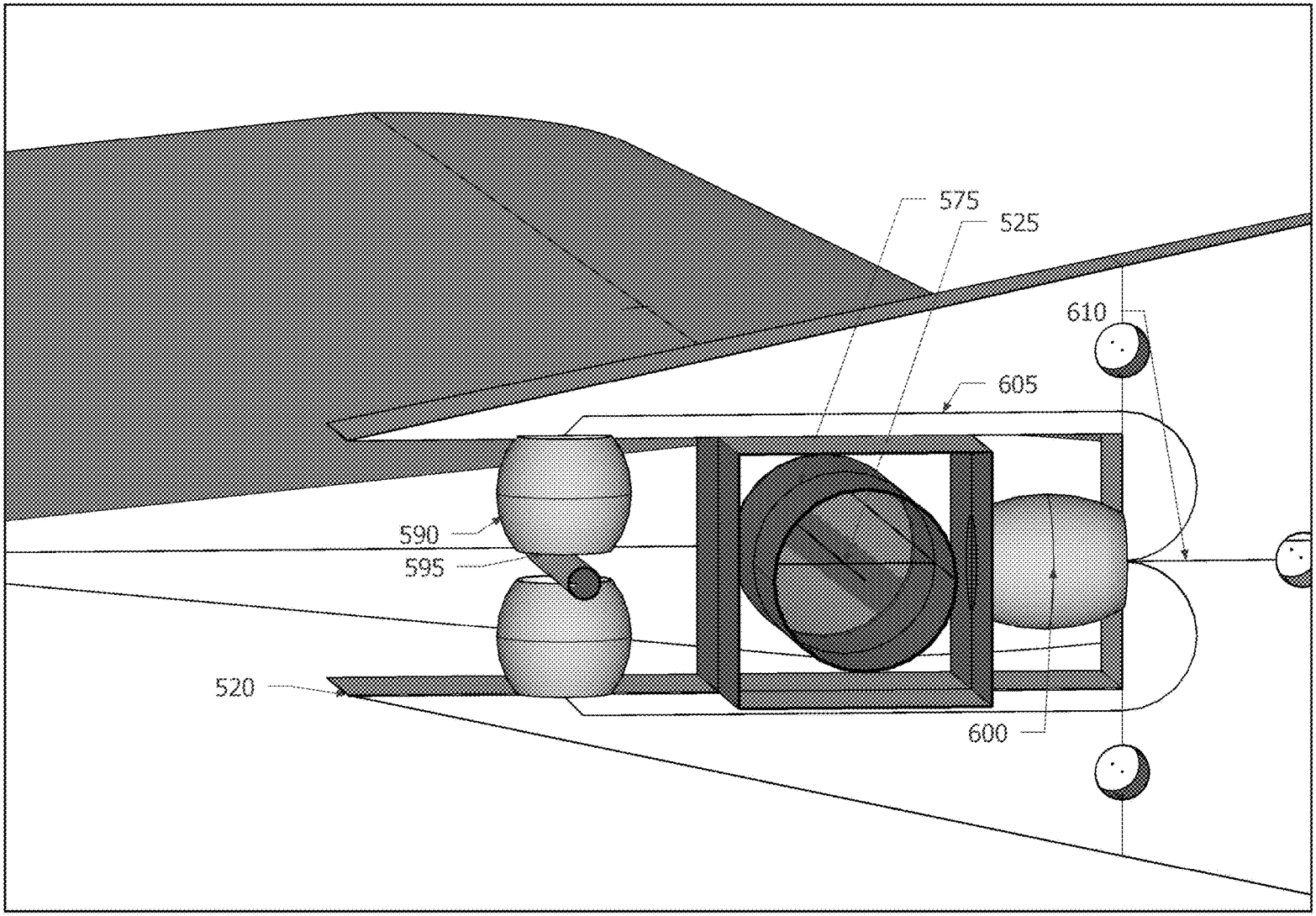
FIG. 36 is a fifth embodiment of a passive and/or active angle of attack control mechanism.

In FIG. 36, fluke trailing rod 595 may be between two inflatable or adjustable springs 590. The inflatable or adjustable springs 590 may be connected, for example, via feedback channel 605, to a feedback reservoir 600. As fluke develops thrust, it moves forward within the fluke clasp 520 (only one-half of the fluke clasp is illustrated in FIG. 36), against the feedback reservoir 600, increasing pressure within or of feedback reservoir 600. The increasing pressure within or of feedback reservoir 600 may be communicated to the inflatable or adjustable springs 590, causing the inflatable or adjustable springs 590 to reduce allowed rotation of the fluke about the rotational juncture. Compressor line 610 may provide an external way to change compression of adjustable or inflatable springs 590. Fluke CoD 525 may be present within fluke bearing 575.

Figure 37:
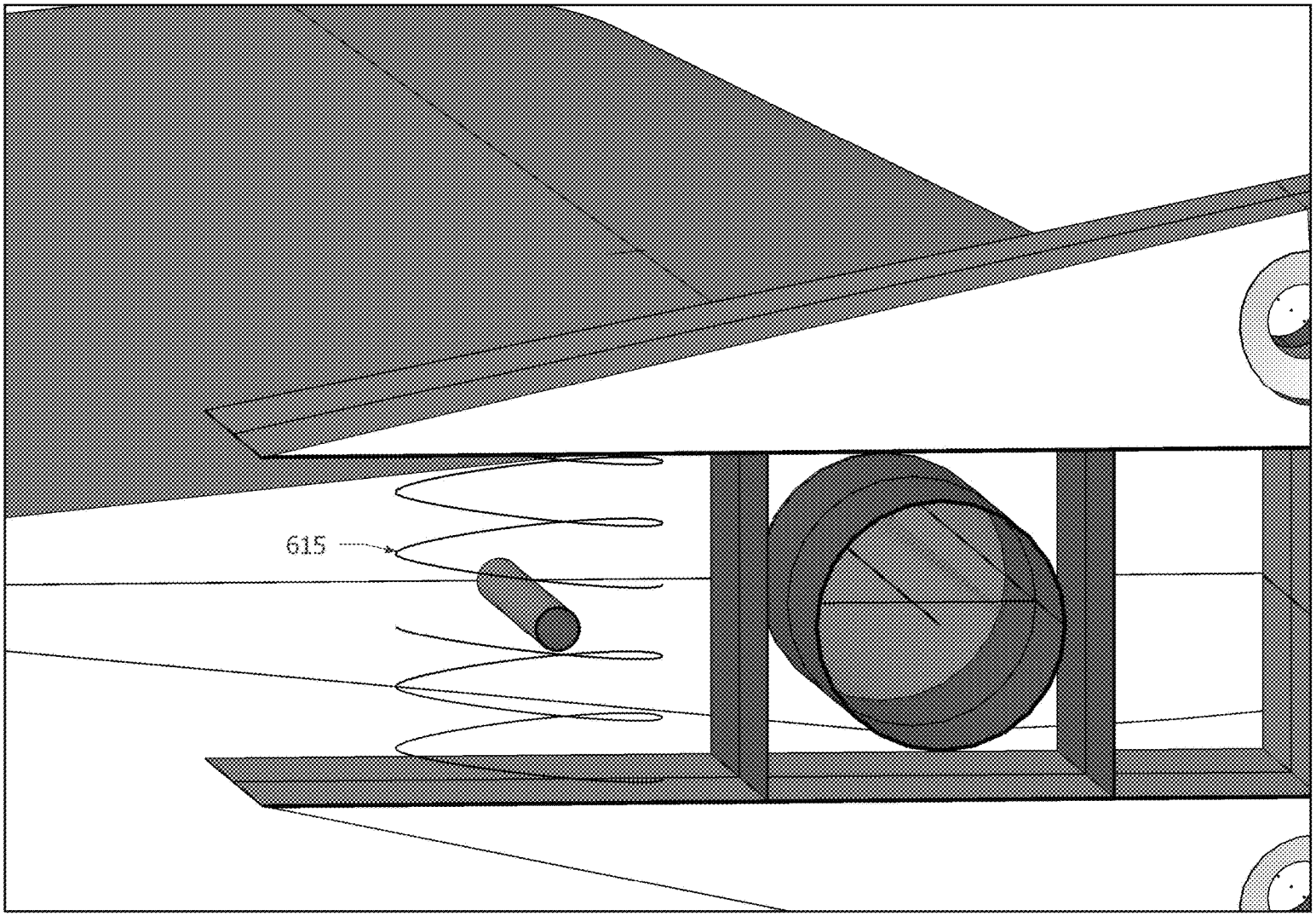
FIG. 37 is a sixth embodiment of a passive and/or active angle of attack control mechanism.

In FIG. 37, the trailing fluke rod may limit rotation of the fluke about the rotational juncture in combination with spring or an adjustable spring 615. Spring or adjustable spring may be adjusted by an externally powered mechanism. Spring or adjustable spring 615 may be adjusted by power supplied by fluke. For example, when fluke develops thrust and the rotational juncture slides forward, the trailing fluke rod may intersect with a portion of spring or adjustable spring 615 which has less flexure. The spring or adjustable spring may provide the back-force, against movement of the rotational juncture forward. Thus, when the amount of thrust produced by the fluke goes down, the spring or adjustable spring may push the fluke backward. In the further back position, fluke may intersection with a portion of spring or adjustable spring which has more flexure. Compression of spring or adjustable spring as rotational juncture moves forward may decrease flexure of spring or adjustable spring.

Figure 38:
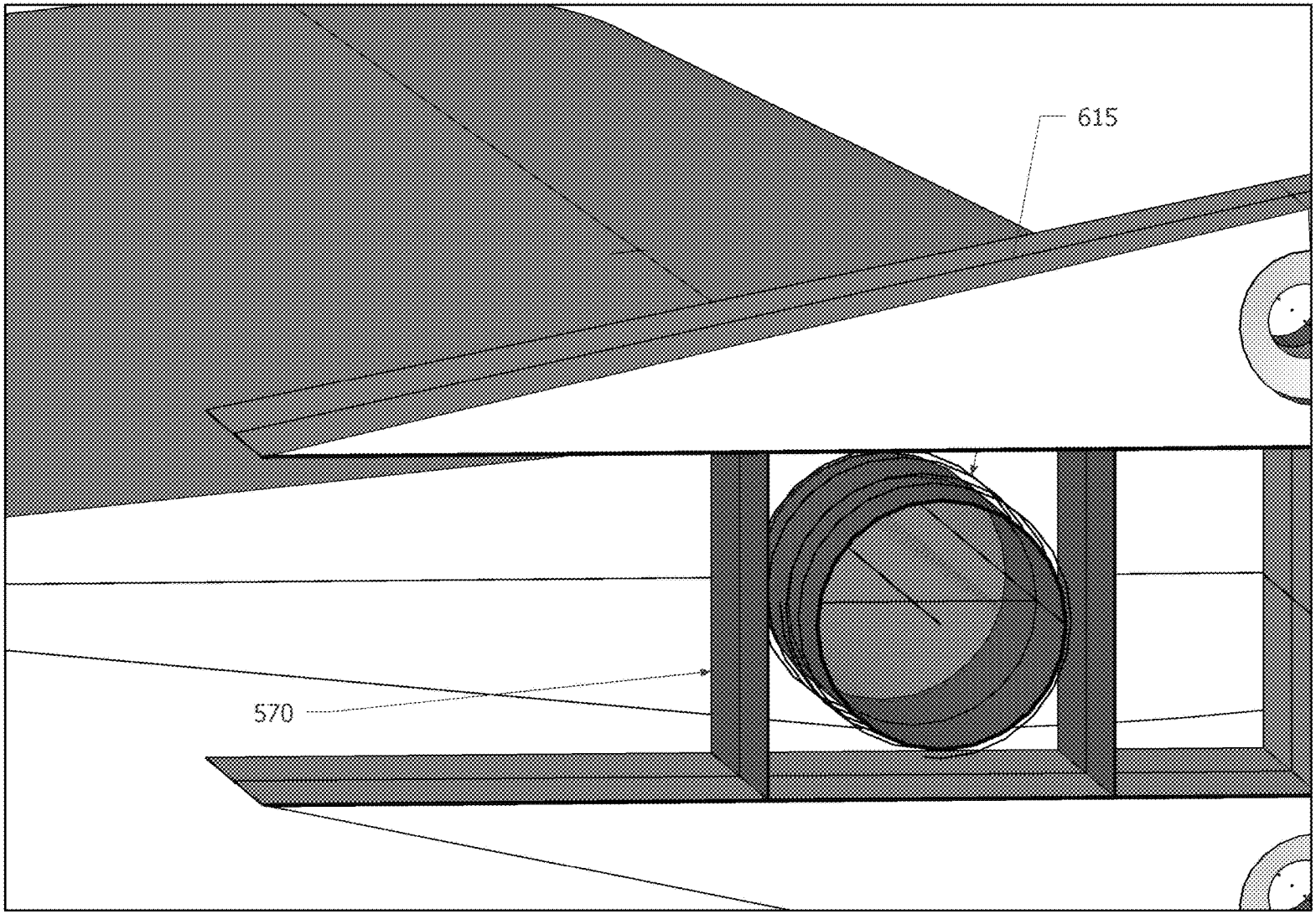
FIG. 38 is a seventh embodiment of a passive and/or active angle of attack control mechanism.

In FIG. 38, spring or adjustable spring 615 may be located around the fluke rod, such as within the fluke bearing housing 570. Spring or adjustable spring may be anchored, on one end, on the fluke rod and, on the other end, on the craft, As the fluke generates more thrust, such as when it is heaved harder, and the fluke bearing housing slides forward within the fluke clasp, the adjustable spring may be compressed, reducing its flexure, decreasing allowed rotation of fluke within rotational junction, and increasing back-pressure on the fluke bearing housing. As the fluke generates less thrust, such as when it is heaved less hard, back-pressure on the fluke bearing housing may push fluke bearing housing backward within fluke clasp, compression of spring or adjustable spring 615 decreases, flexure of spring or adjustable spring 615 increases, and allowed rotation of fluke within rotational junction increases.

Figure 39:
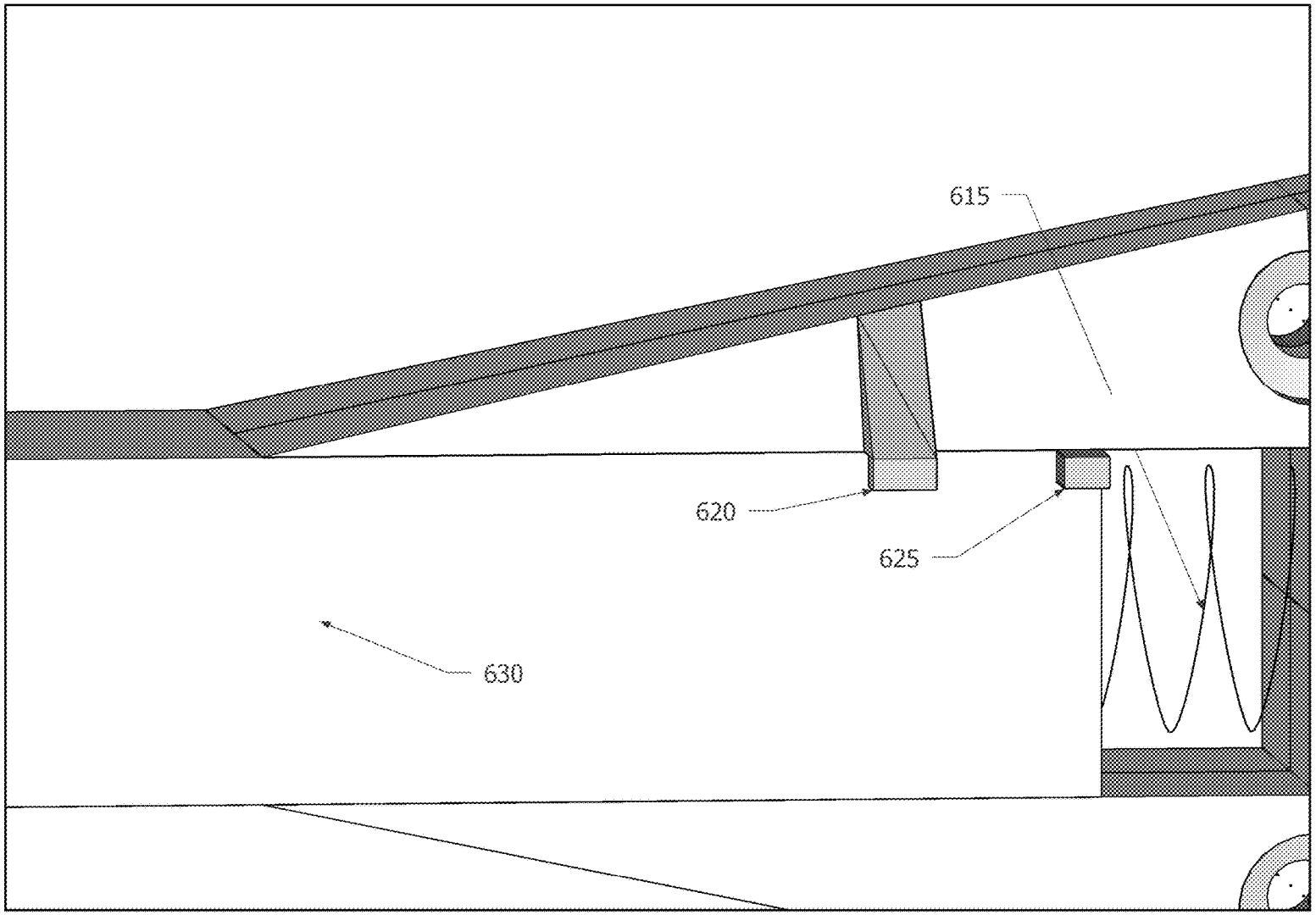
FIG. 39 is an eighth embodiment of a passive and/or active angle of attack control mechanism.

In FIG. 39, the fluke may connect to the craft via a fluke tendon 630. The fluke tendon 630 may be flexible. Flexure of the fluke tendon 630 may be constant or my be variable. As the fluke is heaved up and down in the thrust fluid by rotation of the craft caused by the TRE and as the fluke thereby generates thrust, it may drive the fluke tendon 630 forward within the fluke clasp. Shortening the length of the fluke tendon may reduce the flexure of the fluke tendon, thereby reducing the allowed angle of attack achieved by the fluke. As thrust produced by the fluke reduces, such as when rotation of the craft by the TRE is reduced, the spring 615 may push the fluke tendon out, increasing the flexure of fluke tendon and increasing the allowed angle of attack available to the fluke.

Figure 40:
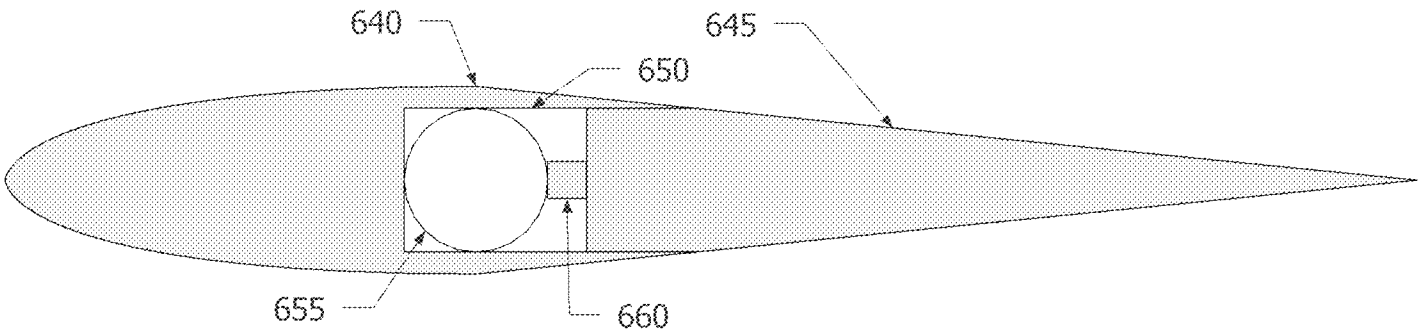
FIG. 40 is a ninth embodiment of a passive and/or active angle of attack control mechanism.

In FIG. 40, the rod and rotational junction (which may be referred to as a "fluke, pivot rod") may move within a channel 650 within the fluke. Movement of the rotational junction within the channel 650 allows the rotational junction to be relocated away from the center of displacement of the fluke. When the rotational junction is at the center of displacement, and when the rotational junction and fluke are translated through the surrounding thrust fluid, the fluke will not generate lift or thrust, but will only experience drag. When the rotational junction is fore or aft of the center of displacement, the fluke will generate lift or thrust, in addition to drag.

As illustrated in FIG. 40, movement of the rotational junction within the channel 650 may be accomplished by an angle of attack adjustor 660. The Angle of attack adjustor 660 may be a spring that pushes the rotational junction forward within the channel 650. Pressure to compress the spring and allow the rotational junction to move aft within the channel may be provided by thrust produced by the fluke.

When moved fore or aft of the center of displacement, the fluke may generate thrust, may generate no thrust, or may generate reverse thrust. When moved fore or aft of the center of displacement, the fluke may generate thrust up to a point, after which the fluke may generate negative thrust.

Alternatively or in addition, the angle of attack adjustor may comprise a power input, wherein the power input allows or causes the angle of attack adjustor to be expanded or contracted.

Alternatively or in addition, the rotational junction may occupy a fixed location relative to either or both of the fluke, fore structure and/or the fluke, aft structure. In this case, the angle of attack adjustor may cause, for example, the fluke, aft structure 645 to move within the channel, effectively lengthening or shortening the fluke, changing the location of the center of displacement of the fluke. When the center of displacement of the fluke is changed, the rotational junction may then be at a location other than the center of displacement and may generate thrust, no thrust, or reverse thrust. Fluke, aft structure 646. Fluke, fore structure 640. Fluke, pivot rod. 655.

Alternatively or in addition, the fluke of FIG. 40 may further comprise a spring connection or another limiter of rotation, with which the system of FIG. 40 may interact.

The invention claimed is:

1. A fluke attached to a craft by a variable angle of attack mechanism, wherein the variable angle of attack mechanism receives a thrust from the fluke and passively and dynamically adjusts an allowed range of angle of attack of the fluke in response to a change in the thrust from the fluke.

2. The fluke according to claim 1, wherein the variable angle of attack mechanism comprises a spring and wherein the change in the thrust from the fluke changes a compression of the spring and wherein the compression of the spring passively and dynamically adjusts the allowed range of angle of attack of the fluke.

3. The fluke according to claim 2, wherein the change in the thrust from the fluke is positive and results in compression of or increased tension on the spring and reduces the allowed range of angle of attack of the fluke by reducing allowed rotation of the fluke about a rotational junction.

4. The fluke according to claim 1, wherein the variable angle of attack mechanism comprises a fluke clasp, wherein, in response to the change in thrust from the fluke, the fluke moves fore and aft relative to the craft, and passively and dynamically adjusts the allowed range of angle of attack of the fluke.

5. The fluke according to one claim 1, wherein the variable angle of attack mechanism comprises a fluke tendon and a spring and wherein the spring pushes the fluke tendon away from the craft to increase a flexure of the fluke tendon and increase the range of angle of attack of the fluke and wherein the thrust of the fluke pushes the fluke tendon toward the craft to decrease the flexure of the fluke tendon.

6. The fluke according to claim 1, wherein the variable angle of attack mechanism comprises a ribbon or drogue trailing from an aft portion of the fluke.

7. A torque reaction engine for a craft, wherein the torque reaction engine comprises a rotor and a stator, wherein the rotor comprises an inertial mass and wherein the rotor is physically secured only to the stator and only by a bearing, wherein the bearing only allows the rotor and inertial mass to rotate about the stator, wherein the rotor and stator comprise an electric motor, and wherein the electric motor is to cause an alternating torque reaction on the stator by an alternating positive and negative acceleration of the rotor and inertial mass relative to the stator, wherein the alternating torque reaction on the stator causes the stator to undergo cyclic counter-rotation, wherein a hull of the craft is secured to the stator and thereby also undergoes cyclic counter-rotation, wherein the hull comprises a fin, wherein cyclic counter-rotation of the hull thereby causes the fin to translate through a surrounding thrust fluid and develop at least one of thrust or lift.

* * * * *